US009830921B2

(12) United States Patent
Atti et al.

(10) Patent No.: US 9,830,921 B2
(45) Date of Patent: Nov. 28, 2017

(54) HIGH-BAND TARGET SIGNAL CONTROL

(71) Applicant: QUALCOMM Incorporated, San Diego, CA (US)

(72) Inventors: Venkatraman Atti, San Diego, CA (US); Venkata Subrahmanyam Chandra Sekhar Chebiyyam, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 15/169,633

(22) Filed: May 31, 2016

(65) Prior Publication Data

US 2017/0053658 A1 Feb. 23, 2017

Related U.S. Application Data

(60) Provisional application No. 62/206,197, filed on Aug. 17, 2015.

(51) Int. Cl.

| | |
|---|---|
| ***G10L 19/00*** | (2013.01) |
| ***G10L 19/16*** | (2013.01) |
| ***G10L 19/02*** | (2013.01) |
| ***G10L 19/24*** | (2013.01) |
| ***G10L 25/06*** | (2013.01) |

(52) U.S. Cl.

CPC ..... *G10L 19/167* (2013.01); *G10L 19/0208* (2013.01); *G10L 19/173* (2013.01); *G10L 19/24* (2013.01); *G10L 25/06* (2013.01)

(58) Field of Classification Search

USPC ..... 704/231–257

See application file for complete search history.

(56) References Cited

U.S. PATENT DOCUMENTS 4,461,024 A * 7/1984 Rengger ..... G10L 15/20 704/207

7,092,881 B1 * 8/2006 Aguilar ..... G10L 19/093 704/207

8,738,370 B2 * 5/2014 Mitsuyoshi ..... G10L 25/90 704/207

(Continued)

OTHER PUBLICATIONS

Atti V., et al., "Super-wideband Bandwidth Extension for Speech in the 3GPP EVS Codes," 2015 IEEE International Conference on Acoustics, Speech and Signal Processing (ICASSP), Apr. 1, 2015 (Apr. 1, 2015), pp. 5927-5931, XP055297165, DOI: 10.1109/ICASSP.2015.7179109 ISBN: 978-1-4673-6997-8.

(Continued)

*Primary Examiner* — Jesse Pullias

(74) *Attorney, Agent, or Firm* — Toler Law Group, PC

(57) ABSTRACT

A method for generating a high-band target signal includes receiving, at an encoder, an input signal having a low-band portion and a high-band portion. The method also includes comparing a first autocorrelation value of the input signal to a second autocorrelation value of the input signal. The method further includes scaling the input signal by a scaling factor to generate a scaled input signal. The scaling factor is determined based on a result of the comparison. The method also includes generating a low-band signal based on the input signal and generating the high-band target signal based on the scaled input signal.

37 Claims, 6 Drawing Sheets

(56) References Cited

U.S. PATENT DOCUMENTS

2007/0088558 A1* 4/2007 Vos ..... G10L 19/0208
704/275

OTHER PUBLICATIONS

International Search Report and Written Opinion—PCT/US2016/042648—ISA/EPO—dated Oct. 12, 2016.

"Universal Mobile Telecommunications System (UMTS); LTE; Codec for Enhanced Voice Services (EVS); Detailed algorithmic description (3GPP TS 26.445 version 12.2.1 Release 12)," Technical Specification, European Telecommunications Standards Institute (ETSI), 650, Route Des Lucioles ; F-06921 Sophia-Antipolis ; France, vol. 3GPP SA 4, No. V12.2.1, Jun. 1, 2015 (Jun. 1, 2015), XP014262205, pp. 217-219.

"Universal Mobile Telecommunications System (UMTS); LTE; Codec for Enhanced Voice Services (EVS); Detailed Algorithmic Description (3GPP TS 26.445 version 12.4.0 Release 12)," Technical Specification, European Telecommunications Standards Institute (ETSI), 650, Route Des Lucioles ; F-06921 Sophia-Antipolis ; France, vol. 3GPP SA 4, No. V12.4.0, Oct. 1, 2015 (Oct. 1, 2015), XP014265320, pp. 219-221.

* cited by examiner

HIGH-BAND TARGET SIGNAL CONTROL

I. CROSS-REFERENCE TO RELATED APPLICATIONS

The present application claims priority from U.S. Provisional Patent Application No. 62/206,197, filed Aug. 17, 2015, entitled "HIGH-BAND TARGET SIGNAL CONTROL," which is incorporated by reference in its entirety.

II. FIELD

The present disclosure is generally related to signal processing.

III. DESCRIPTION OF RELATED ART

Advances in technology have resulted in smaller and more powerful computing devices. For example, there currently exist a variety of portable personal computing devices, including wireless computing devices, such as portable wireless telephones, personal digital assistants (PDAs), and paging devices that are small, lightweight, and easily carried by users. More specifically, portable wireless telephones, such as cellular telephones and Internet Protocol (IP) telephones, can communicate voice and data packets over wireless networks. Further, many such wireless telephones include other types of devices that are incorporated therein. For example, a wireless telephone can also include a digital still camera, a digital video camera, a digital recorder, and an audio file player.

Transmission of voice by digital techniques is widespread, particularly in long distance and digital radio telephone applications. There may be an interest in determining the least amount of information that can be sent over a channel while maintaining a perceived quality of reconstructed speech. If speech is transmitted by sampling and digitizing, a data rate on the order of sixty-four kilobits per second (kbps) may be used to achieve a speech quality of an analog telephone. Through the use of speech analysis, followed by coding, transmission, and re-synthesis at a receiver, a significant reduction in the data rate may be achieved.

Devices for compressing speech may find use in many fields of telecommunications. An exemplary field is wireless communications. The field of wireless communications has many applications including, e.g., cordless telephones, paging, wireless local loops, wireless telephony such as cellular and personal communication service (PCS) telephone systems, mobile IP telephony, and satellite communication systems. A particular application is wireless telephony for mobile subscribers.

Various over-the-air interfaces have been developed for wireless communication systems including, e.g., frequency division multiple access (FDMA), time division multiple access (TDMA), code division multiple access (CDMA), and time division-synchronous CDMA (TD-SCDMA). In connection therewith, various domestic and international standards have been established including, e.g., Advanced Mobile Phone Service (AMPS), Global System for Mobile Communications (GSM), and Interim Standard 95 (IS-95). An exemplary wireless telephony communication system is a code division multiple access (CDMA) system. The IS-95 standard and its derivatives, IS-95A, ANSI J-STD-008, and IS-95B (referred to collectively herein as IS-95), are promulgated by the Telecommunication Industry Association (TIA) and other well-known standards bodies to specify the use of a CDMA over-the-air interface for cellular or PCS telephony communication systems.

The IS-95 standard subsequently evolved into "3G" systems, such as cdma2000 and WCDMA, which provide more capacity and high speed packet data services. Two variations of cdma2000 are presented by the documents IS-2000 (cdma2000 1xRTT) and IS-856 (cdma2000 1xEV-DO), which are issued by TIA. The cdma2000 1xRTT communication system offers a peak data rate of 153 kbps whereas the cdma2000 1xEV-DO communication system defines a set of data rates, ranging from 38.4 kbps to 2.4 Mbps. The WCDMA standard is embodied in 3rd Generation Partnership Project "3GPP", Document Nos. 3G TS 25.211, 3G TS 25.212, 3G TS 25.213, and 3G TS 25.214. The International Mobile Telecommunications Advanced (IMT-Advanced) specification sets out "4G" standards. The IMT-Advanced specification sets peak data rate for 4G service at 100 megabits per second (Mbit/s) for high mobility communication (e.g., from trains and cars) and 1 gigabit per second (Gbit/s) for low mobility communication (e.g., from pedestrians and stationary users).

Devices that employ techniques to compress speech by extracting parameters that relate to a model of human speech generation are called speech coders. Speech coders may comprise an encoder and a decoder. The encoder divides the incoming speech signal into blocks of time, or analysis frames. The duration of each segment in time (or "frame") may be selected to be short enough that the spectral envelope of the signal may be expected to remain relatively stationary. For example, one frame length is twenty milliseconds, which corresponds to 160 samples at a sampling rate of eight kilohertz (kHz), although any frame length or sampling rate deemed suitable for the particular application may be used.

The encoder analyzes the incoming speech frame to extract certain relevant parameters, and then quantizes the parameters into binary representation, e.g., to a set of bits or a binary data packet. The data packets are transmitted over a communication channel (i.e., a wired and/or wireless network connection) to a receiver and a decoder. The decoder processes the data packets, unquantizes the processed data packets to produce the parameters, and resynthesizes the speech frames using the unquantized parameters.

The function of the speech coder is to compress the digitized speech signal into a low-bit-rate signal by removing natural redundancies inherent in speech. The digital compression may be achieved by representing an input speech frame with a set of parameters and employing quantization to represent the parameters with a set of bits. If the input speech frame has a number of bits $N_i$ and a data packet produced by the speech coder has a number of bits $N_o$, the compression factor achieved by the speech coder is $C_r=N_i/N_o$. The challenge is to retain high voice quality of the decoded speech while achieving the target compression factor. The performance of a speech coder depends on (1) how well the speech model, or the combination of the analysis and synthesis process described above, performs, and (2) how well the parameter quantization process is performed at the target bit rate of $N_o$ bits per frame. The goal of the speech model is thus to capture the essence of the speech signal, or the target voice quality, with a small set of parameters for each frame.

Speech coders generally utilize a set of parameters (including vectors) to describe the speech signal. A good set of parameters ideally provides a low system bandwidth for the reconstruction of a perceptually accurate speech signal.

Pitch, signal power, spectral envelope (or formants), amplitude and phase spectra are examples of the speech coding parameters.

Speech coders may be implemented as time-domain coders, which attempt to capture the time-domain speech waveform by employing high time-resolution processing to encode small segments of speech (e.g., 5 millisecond (ms) sub-frames) at a time. For each sub-frame, a high-precision representative from a codebook space is found by means of a search algorithm. Alternatively, speech coders may be implemented as frequency-domain coders, which attempt to capture the short-term speech spectrum of the input speech frame with a set of parameters (analysis) and employ a corresponding synthesis process to recreate the speech waveform from the spectral parameters. The parameter quantizer preserves the parameters by representing them with stored representations of code vectors in accordance with known quantization techniques.

One time-domain speech coder is the Code Excited Linear Predictive (CELP) coder. In a CELP coder, the short-term correlations, or redundancies, in the speech signal are removed by a linear prediction (LP) analysis, which finds the coefficients of a short-term formant filter. Applying the short-term prediction filter to the incoming speech frame generates an LP residual signal, which is further modeled and quantized with long-term prediction filter parameters and a subsequent stochastic codebook. Thus, CELP coding divides the task of encoding the time-domain speech waveform into the separate tasks of encoding the LP short-term filter coefficients and encoding the LP residual. Time-domain coding can be performed at a fixed rate (i.e., using the same number of bits, $N_o$, for each frame) or at a variable rate (in which different bit rates are used for different types of frame contents). Variable-rate coders attempt to use the amount of bits needed to encode the codec parameters to a level adequate to obtain a target quality.

Time-domain coders such as the CELP coder may rely upon a high number of bits, No, per frame to preserve the accuracy of the time-domain speech waveform. Such coders may deliver excellent voice quality provided that the number of bits, $N_o$, per frame is relatively large (e.g., 8 kbps or above). At low bit rates (e.g., 4 kbps and below), time-domain coders may fail to retain high quality and robust performance due to the limited number of available bits. At low bit rates, the limited codebook space reduces the waveform-matching capability of time-domain coders, which are deployed in higher-rate commercial applications. Hence, despite improvements over time, many CELP coding systems operating at low bit rates suffer from perceptually significant distortion characterized as noise.

An alternative to CELP coders at low bit rates is the "Noise Excited Linear Predictive" (NELP) coder, which operates under similar principles as a CELP coder. NELP coders use a filtered pseudo-random noise signal to model speech, rather than a codebook. Since NELP uses a simpler model for coded speech, NELP achieves a lower bit rate than CELP. NELP may be used for compressing or representing unvoiced speech or silence.

Coding systems that operate at rates on the order of 2.4 kbps are generally parametric in nature. That is, such coding systems operate by transmitting parameters describing the pitch-period and the spectral envelope (or formants) of the speech signal at regular intervals. Illustrative of these so-called parametric coders is the LP vocoder system.

LP vocoders model a voiced speech signal with a single pulse per pitch period. This basic technique may be augmented to include transmission information about the spectral envelope, among other things. Although LP vocoders provide reasonable performance generally, they may introduce perceptually significant distortion, characterized as buzz.

In recent years, coders have emerged that are hybrids of both waveform coders and parametric coders. Illustrative of these so-called hybrid coders is the prototype-waveform interpolation (PWI) speech coding system. The PWI coding system may also be known as a prototype pitch period (PPP) speech coder. A PWI coding system provides an efficient method for coding voiced speech. The basic concept of PWI is to extract a representative pitch cycle (the prototype waveform) at fixed intervals, to transmit its description, and to reconstruct the speech signal by interpolating between the prototype waveforms. The PWI method may operate either on the LP residual signal or the speech signal.

There may be research interest and commercial interest in improving audio quality of a speech signal (e.g., a coded speech signal, a reconstructed speech signal, or both). For example, a communication device may receive a speech signal with lower than optimal voice quality. To illustrate, the communication device may receive the speech signal from another communication device during a voice call. The voice call quality may suffer due to various reasons, such as environmental noise (e.g., wind, street noise), limitations of the interfaces of the communication devices, signal processing by the communication devices, packet loss, bandwidth limitations, bit-rate limitations, etc.

In traditional telephone systems (e.g., public switched telephone networks (PSTNs)), signal bandwidth is limited to the frequency range of 300 Hertz (Hz) to 3.4 kHz. In wideband (WB) applications, such as cellular telephony and voice over internet protocol (VoIP), signal bandwidth may span the frequency range from approximately 0 kHz to 8 kHz. Super wideband (SWB) coding techniques support bandwidth that extends up to around 16 kHz. Extending signal bandwidth from narrowband telephony at 3.4 kHz to SWB telephony of 16 kHz may improve the quality of signal reconstruction, intelligibility, and naturalness.

WB coding techniques typically involve encoding and transmitting the lower frequency portion of the input signal (e.g., 0 Hz to 6 kHz, also called the "low-band"). For example, the low-band may be represented using filter parameters and/or a low-band excitation signal. However, in order to improve coding efficiency, the higher frequency portion of the input signal (e.g., 6 kHz to 8 kHz, also called the "high-band") may not be fully encoded and transmitted. Instead, a receiver may utilize signal modeling to predict the high-band. In some implementations, data associated with the high-band may be provided to the receiver to assist in the prediction. Such data may be referred to as "side information," and may include gain information, line spectral frequencies (LSFs, also referred to as line spectral pairs (LSPs)), etc.

Predicting the high-band using signal modeling may include generating a high-band target signal at the encoder. The high-band target signal may be used to estimate an LP spectral envelope and to estimate temporal gain parameters of the high-band. To generate the high-band target signal, the input signal may undergo a "spectral flip" operation to generate a spectrally flipped signal such that the 8 kHz frequency component of the input signal is located at a 0 kHz frequency of the spectrally flipped signal, and such that the 0 kHz frequency component of the input signal is located at the 8 kHz frequency of the spectrally flipped signal. The spectrally flipped signal may undergo a decimation operation (e.g., a "decimation-by-four" operation) to generate the high-band target signal.

The input signal may be scaled such that a precision of the low-band and the high-band after decimation is preserved. However, if a fixed scaling factor is applied to the entire input signal when a first energy level of the low-band is several times greater than a second energy level of the high-band, the high-band may lose precision after the spectral flip operation and the decimation operation. Subsequently, high-band gain parameters that are estimated may be coarsely quantized and result in artifacts.

IV. SUMMARY

According to one implementation of the present disclosure, a method for generating a high-band target signal includes receiving, at an encoder, an input signal having a low-band portion and a high-band portion. The method also includes comparing a first autocorrelation value of the input signal to a second autocorrelation value of the input signal. The method further includes scaling the input signal by a scaling factor to generate a scaled input signal. The scaling factor is determined based on a result of the comparison. Alternatively, the value of a pre-determined scaling factor is modified based on the result of the comparison. The method also includes generating a low-band signal based on the input signal and generating the high-band target signal based on the scaled input signal. The low-band signal is generated independently of the scaled input signal.

According to another implementation of the present disclosure, an apparatus includes an encoder and a memory storing instructions that are executable by a processor within the encoder to perform operations. The operations include comparing a first autocorrelation value of an input signal to a second autocorrelation value of the input signal. The input signal has a low-band portion and a high-band portion. The operations further include scaling the input signal by a scaling factor to generate a scaled input signal. The scaling factor is determined based on a result of the comparison. Alternatively, the value of a pre-determined scaling factor is modified based on the result of the comparison. The operations also include generating a low-band signal based on the input signal and generating a high-band target signal based on the scaled input signal. The low-band signal is generated independently of the scaled input signal.

According to another implementation of the present disclosure, a non-transitory computer-readable medium includes instructions for generating a high-band target signal. The instructions, when executed by a processor within an encoder, cause the processor to perform operations. The operations include comparing a first autocorrelation value of an input signal to a second autocorrelation value of the input signal. The input signal has a low-band portion and a high-band portion. The operations further include scaling the input signal by a scaling factor to generate a scaled input signal. The scaling factor is determined based on a result of the comparison. Alternatively, the value of a pre-determined scaling factor is modified based on the result of the comparison. The operations also include generating a low-band signal based on the input signal and generating a high-band target signal based on the scaled input signal. The low-band signal is generated independently of the scaled input signal.

According to another implementation of the present disclosure, an apparatus includes means for receiving an input signal having a low-band portion and a high-band portion. The apparatus also includes means for comparing a first autocorrelation value of the input signal to a second autocorrelation value of the input signal. The apparatus further includes means for scaling the input signal by a scaling factor to generate a scaled input signal. The scaling factor is determined based on a result of the comparison. Alternatively, the value of a pre-determined scaling factor is modified based on the result of the comparison. The apparatus also includes means for generating a low-band signal based on the input signal and means for generating the high-band target signal based on the scaled input signal. The low-band signal is generated independently of the scaled input signal.

V. BRIEF DESCRIPTION OF THE DRAWINGS

VI. DETAILED DESCRIPTION

Figure 1:
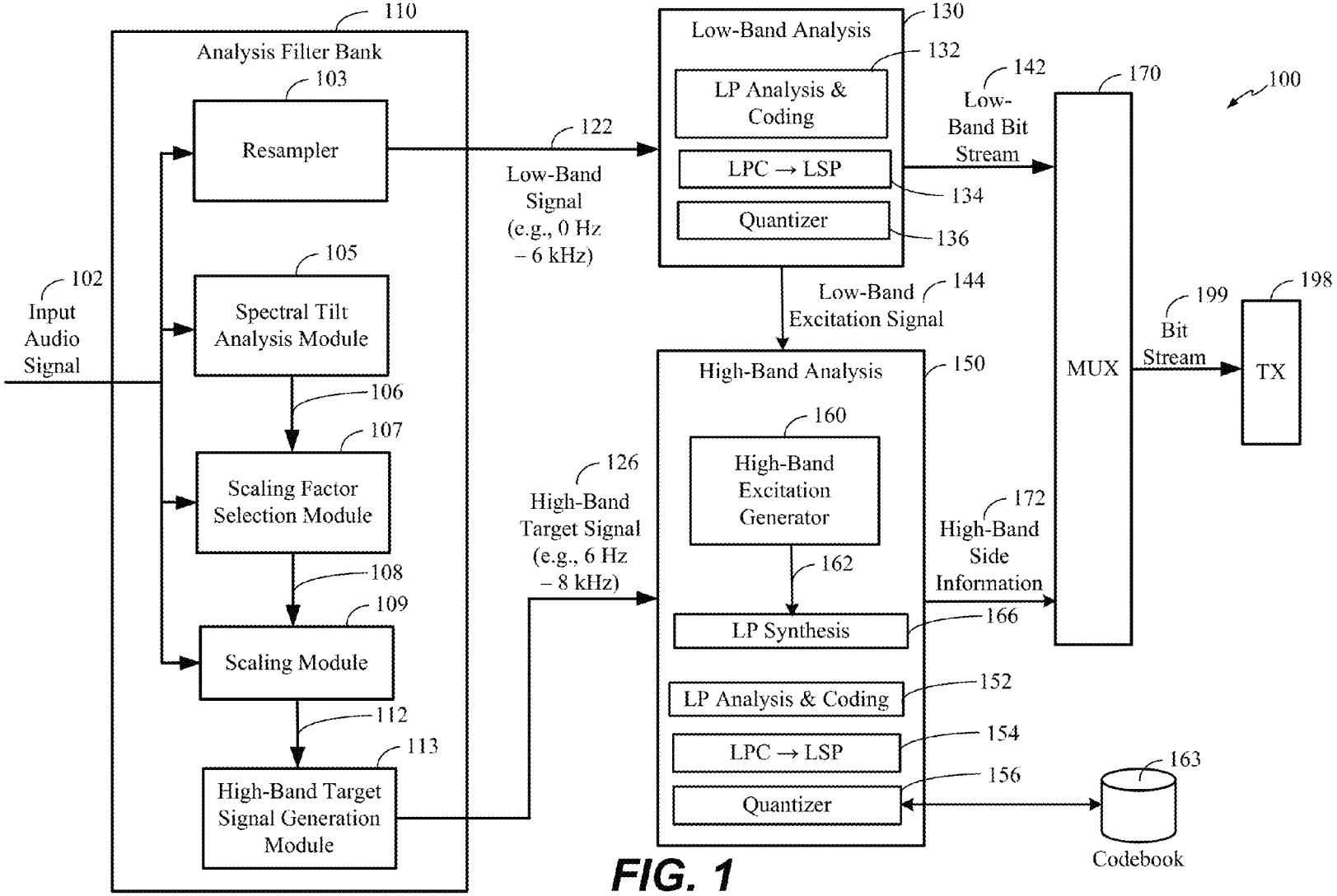
FIG. 1 is a diagram to illustrate a system that is operable to control precision of a high-band target signal.

Techniques for controlling high-band target signal precision are disclosed. An encoder may receive an input signal having a low-band ranging from approximately 0 kHz to 6 kHz and having a high-band ranging from approximately 6 kHz to 8 kHz. The low-band may have a first energy level and the high-band may have a second energy level. The encoder may generate a high-band target signal that is used to estimate an LP spectral envelope of the high-band and to estimate temporal gain parameters of the high-band. The LP spectral envelope and the temporal gain parameters may be encoded and transmitted to a decoder to reconstruct the high-band. The high-band target signal may be generated based on the input signal. To illustrate, the encoder may perform a spectral flip operation on a scaled version of the input signal to generate a spectrally flipped signal, and the spectrally flipped signal may undergo decimation to generate the high-band target signal.

Typically, the input signal is scaled (based on the peak absolute value of the signal considering the entire frequency band) to include headroom that substantially reduces a likelihood of saturation of the high-band target signal if additional operations are performed during the decimation. For example, a word-16 input signal may include a fixed point range from −32768 to 32767. The encoder may scale the input signal to include three bits of headroom for the purpose of reducing saturation of the high-band target signal. Scaling the input signal to include three bits of headroom may effectively reduce the fixed point range from −4096 to 4095.

If the second energy level of the high-band is significantly lower than the first energy level of the low-band, the high-band target signal may have very low energy or "low precision", and further scaling the input signal to include headroom calculated based on the original input signal's entire frequency band may result in artifacts. To avoid generating a high-band target signal having negligible energy, the encoder may determine a spectral tilt of the input signal. The spectral tilt may be representative of an energy distribution of the high-band to the entire frequency band. For example, the spectral tilt may be based on an autocorrelation ($R_0$) at lag index zero representing an energy of the entire frequency band and based on an autocorrelation ($R_1$) at lag index one. If the spectral tilt fails to satisfy a threshold (e.g., if the first energy level is significantly greater than the second energy level), the encoder may decrease the amount of headroom during scaling of the input signal to provide a greater range for the high-band target signal. Providing a greater range for the high-band target signal may enable more precise energy estimations for a low-energy high-band, which in turn may reduce artifacts. If the spectral tilt satisfies the threshold (e.g., if the first energy level is not significantly greater than the second energy level), the encoder may increase the amount of headroom during scaling of the input signal to reduce the likelihood of saturation of the high-band target signal.

Particular advantages provided by at least one of the disclosed implementations include increasing high-band target signal precision to reduce artifacts. For example, an amount of headroom used during scaling of an input signal may be dynamically adjusted based on a spectral tilt of the input signal. Decreasing the headroom when an energy level of a higher frequency portion of the input signal is significantly less than an energy level of a lower frequency portion of the input signal may result in a greater range for the high-band target signal. The greater range may enable more precise energy estimations for the high-band, which in turn may reduce artifacts. Other implementations, advantages, and features of the present disclosure will become apparent after review of the entire application.

Referring to FIG. 1, a system that is operable to control precision of a high-band target signal is shown and generally designated 100. In a particular implementation, the system 100 may be integrated into an encoding system or apparatus (e.g., in a coder/decoder (CODEC) of a wireless telephone). In other implementations, the system 100 may be integrated into a set top box, a music player, a video player, an entertainment unit, a navigation device, a communications device, a PDA, a fixed location data unit, or a computer, as illustrative non-limiting examples. In a particular implementation, the system 100 may correspond to, or be included in, a vocoder.

It should be noted that in the following description, various functions performed by the system 100 of FIG. 1 are described as being performed by certain components or modules. However, this division of components and modules is for illustration only. In an alternate implementation, a function performed by a particular component or module may instead be divided amongst multiple components or modules. Moreover, in an alternate implementation, two or more components or modules of FIG. 1 may be integrated into a single component or module. Each component or module illustrated in FIG. 1 may be implemented using hardware (e.g., a field-programmable gate array (FPGA) device, an application-specific integrated circuit (ASIC), a digital signal processor (DSP), a controller, etc.), software (e.g., instructions executable by a processor), or any combination thereof.

The system 100 includes an analysis filter bank 110 that is configured to receive an input audio signal 102. For example, the input audio signal 102 may be provided by a microphone or other input device. In a particular implementation, the input audio signal 102 may include speech. The input audio signal 102 may include speech content in the frequency range from approximately 0 Hz to approximately 8 kHz. As used herein, "approximately" may include frequencies within a particular range of the described frequency. For example, approximately may include frequencies within ten percent of the described frequency, five percent of the described frequency, one percent of the described frequency, etc. As an illustrative non-limiting example, "approximately 8 kHz" may include frequencies from 7.6 kHz (e.g., 8 kHz-8 kHz*0.05) to 8.4 kHz (e.g., 8 kHz+8 kHz*0.05). The input audio signal 102 may include a low-band portion spanning from approximately 0 Hz to 6 kHz and a high-band portion spanning from approximately 6 kHz to 8 kHz. It should be understood that although the input audio signal 102 is depicted as a Wideband signal (e.g., a signal having a frequency range between 0 Hz and 8 kHz), the techniques described with respect to the present disclosure may also be applicable to Super Wideband signals (e.g., a signal having a frequency range between 0 Hz and 16 kHz) and Full Band signals (e.g., a signal having a frequency range between 0 Hz and 20 kHz).

The analysis filter bank 110 includes a resampler 103, a spectral tilt analysis module 105, a scaling factor selection module 107, a scaling module 109, and a high-band target signal generation module 113. The input audio signal 102 may be provided to the resampler 103, the spectral tilt analysis module 105, and the scaling module 109. The resampler 103 may be configured to filter out high-frequency components of the input audio signal 102 to generate a low-band signal 122. For example, the resampler 103 may have a cut-off frequency of approximately 6.4 kHz to generate a low-band signal 122 having a bandwidth that extends from approximately 0 Hz to approximately 6.4 kHz.

The spectral tilt analysis module 105, the scaling factor selection module 107, the scaling module 109, and the high-band target signal generation module 113 may operate in conjunction to generate a high-band target signal 126 that is used to estimate an LP spectral envelope of the high-band of the input audio signal 102 and used to estimate temporal gain parameters of the high-band of the input audio signal 102. To illustrate, the spectral tilt analysis module 105 may determine a spectral tilt associated with the input audio signal 102. The spectral tilt may be based on an energy distribution of the input audio signal 102. For example, the spectral tilt may be based on a ratio between an autocorrelation ($R_0$) at lag index zero representing an energy of the entire frequency band of the input audio signal 102 in the time domain and an autocorrelation ($R_1$) at lag index one representing an energy in the time domain. According to one implementation, the autocorrelation ($R_1$) at lag index one may be calculated based on a sum of product of adjacent samples. In the pseudocode described below, the autocorrelation ($R_0$) at lag index zero is designated "temp1" and the autocorrelation ($R_1$) at lag index one is designated "temp2". According to one implementation, the spectral tilt may be expressed as the quotient resulting from the autocorrelation ($R_1$) and the autocorrelation ($R_0$) (e.g., $R_1/R_0$ or temp2/temp1). The spectral tilt analysis module 105 may generate a signal 106 indicating the spectral tilt and may provide the signal 106 to the scaling factor selection module 107.

The scaling factor selection module 107 may select a scaling factor (e.g., a "precision control factor" or a "norm factor") to be used to scale the input audio signal 102. The scaling factor may be based on the spectral tilt indicated by the signal 106. For example, the scaling factor selection module 107 may compare the spectral tilt to a threshold to determine the scaling factor. As a non-limiting example, the scaling factor selection module 107 may compare the spectral tilt to a threshold of ninety-five percent (e.g., 0.95).

If the spectral tilt fails to satisfy the threshold (e.g., is not less than the threshold, i.e., R1/R0>=0.95), then the scaling factor selection module 107 may select a first scaling factor. Selecting the first scaling factor may indicate a scenario where a first energy level of the low-band is significantly greater than a second energy level of the high-band. For example, the energy distribution of the input audio signal 102 may be relatively steep when the spectral tilt fails to satisfy the threshold. If the spectral tilt satisfies the threshold (e.g., is less than the threshold), then the scaling factor module 107 may select a second scaling factor. Selecting the second scaling factor may indicate a scenario where the first energy level of the low-band is not significantly greater than the second energy level of the high-band. For example, the energy distribution of the input audio signal 102 may be relatively even across the low-band and the high-band when the spectral tilt satisfies the threshold criterion (i.e. R1/R0<0.95). As an example, the first scaling factor may be estimated to normalize the input signal to leave a headroom of 3 bits (i.e., limit the input signal to −4096 to 4095 for a 16-bit type signal) and the second scaling factor may be estimated to normalize the input signal to leave no headroom (i.e., limit the input signal to −32768 to 32767 for a 16-bit type signal))

The scaling factor selection module 107 may generate a signal 108 indicative of the selected scaling factor and may provide the signal 108 to the scaling module 109. For example, if the first scaling factor is selected, the signal 108 may have a first value to indicate that the first scaling factor was selected by the scaling factor selection module 107. If the second scaling factor is selected, the signal 108 may have a second value to indicate that the second scaling factor was selected by the scaling factor selection module 107. As an example, the signal 108 may be the selected scale factor value itself.

The scaling module 109 may be configured to scale the input audio signal 102 by the selected scaling factor to generate a scaled input audio signal 112. To illustrate, if the second scaling factor is selected, the scaling module 109 may increase an amount of headroom during scaling of the input audio signal 102 to generate the scaled input audio signal 112. According to one implementation, the scaling module 109 may increase (or maintain) the headroom allocated to the input audio signal 102 to three bits of headroom. As described below, increasing the amount of headroom during scaling of the input audio signal 102 may reduce the likelihood of saturation during generation of the high-band target signal 126. If the first scaling factor is selected, the scaling module 109 may decrease the amount of headroom during scaling of the input audio signal 102 to generate the scaled input audio signal 112. According to one implementation, the scaling module 109 may decrease the headroom allocated to the input audio signal 102 to zero bits of headroom. As described below, decreasing the amount of headroom during scaling of the input audio signal 102 may enable more precise energy estimations for a low-energy high-band, which in turn may reduce artifacts.

The high-band target signal generation module 113 may receive the scaled input audio signal 112 and may be configured to generate the high-band target signal 126 based on the scaled input audio signal 112. To illustrate, the high-band target signal generation module 113 may perform a spectral flip operation on the scaled input audio signal 112 to generate a spectrally flipped signal. For example, the upper frequency components of the scaled input audio signal 112 may be located at a lower frequency of the spectrally flipped signal, and lower frequency components of the scaled input audio signal 112 may be located at an upper frequency of the spectrally flipped signal. Thus, if the scaled input audio signal 112 is has a 8 kHz bandwidth spanning from 0 Hz to 8 kHz, the 8 kHz frequency component of the scaled input audio signal 112 may be located at a 0 kHz frequency of the spectrally flipped signal, and the 0 kHz frequency component of the scaled input audio signal 112 may be located at the 8 kHz frequency of the spectrally flipped signal.

The high-band target signal generation module 113 may be configured perform a decimation operation on the spectrally flipped signal to generate the high-band target signal 126. For example, the high-band target signal generation module 113 may decimate the spectrally flipped signal by a factor of four to generate the high-band target signal 126. The high-band target signal 126 may be a baseband signal spanning from 0 Hz to 2 kHz and may represent the high-band of the input audio signal 102.

Figure 2A:
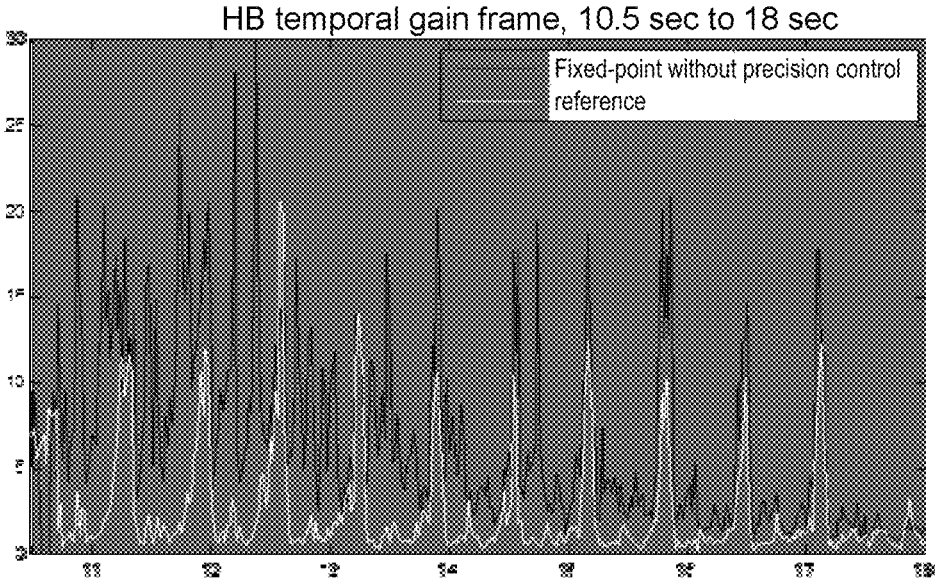
FIG. 2A is a plot of a high-band temporal gains estimate without using a high-band target signal according to the techniques of FIG. 1 compared to reference temporal gains.
Figure 2B:
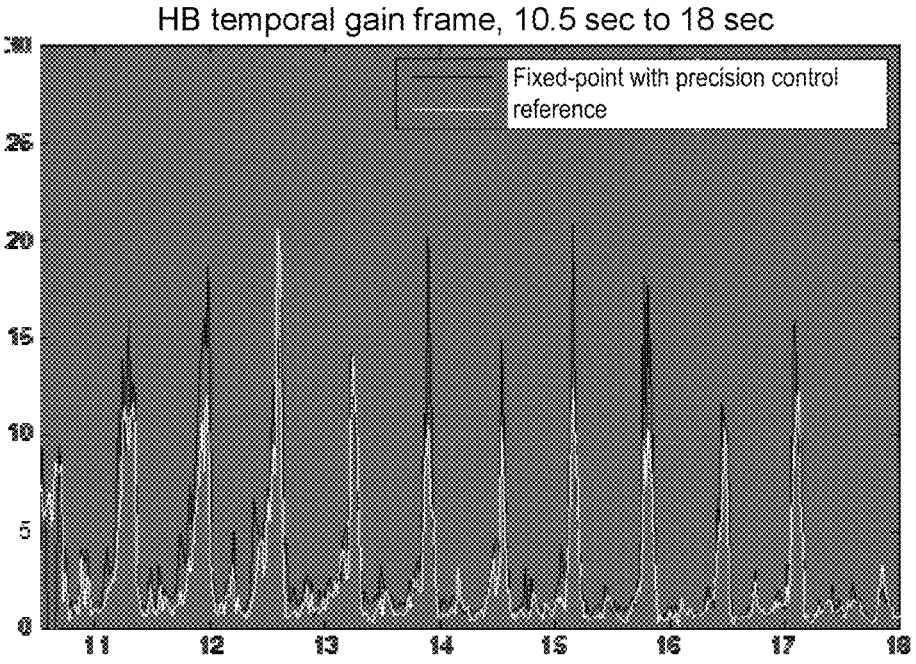
FIG. 2B is a plot of high-band temporal gains estimated using a high-band target signal according to the techniques of FIG. 1 compared to reference temporal gains.

The high-band target signal 126 may have increased precision based on the dynamic scaling factor selected by the scaling factor selection module 107. For example, in scenarios where the first energy level of the low-band is significantly greater than the second energy level of the high-band, the input audio signal 102 may be scaled to decrease the amount of headroom. Decreasing the amount of headroom may provide a greater range to generate the high-band target signal 126 such that the energy of the high-band may be more precisely captured. Precisely capturing the energy of the high-band by the high-band target signal may result improve estimation of high-band gain parameters (e.g., high-band side information 172) and reduce artifacts. For example, referring to FIG. 2B, a plot of high-band temporal gains estimated using the high-band target signal 126 is compared to reference temporal gains is shown. The temporal gains estimated using the high-band target signal 126 closely mimic the reference temporal gains as compared to FIG. 2A where the estimated temporal gains deviate significantly from the reference temporal gains. Thus, reduced artifacts (e.g., noise) may result during signal reconstruction.

Figure 3A:
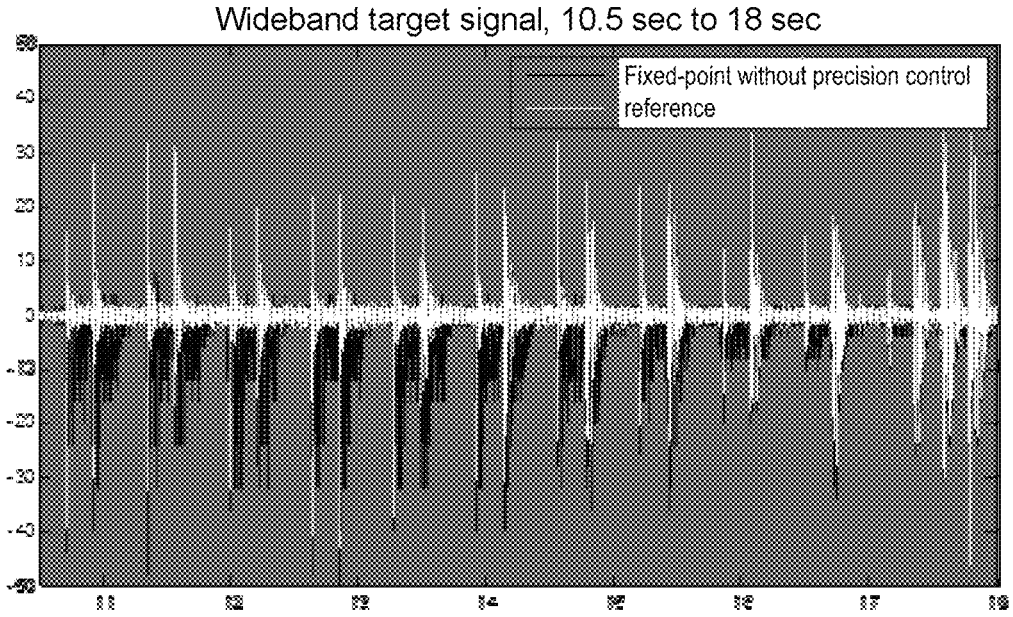
FIG. 3A is a time-domain plot of a wideband target signal without using the precision techniques of FIG. 1 compared to a reference wideband target signal.
Figure 3B:
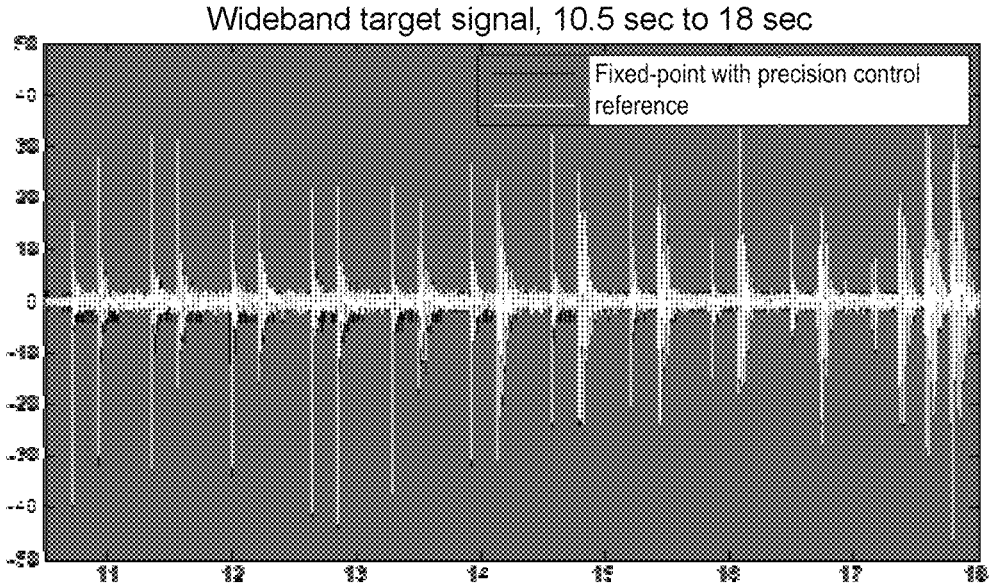
FIG. 3B is a time-domain plot of a wideband target signal using the precision control techniques of FIG. 1 compared to a reference wideband target signal.

In scenarios where the first energy level of the low-band is not significantly greater than the second energy level of the high-band, the input audio signal 102 may be scaled to increase the amount of headroom. Increasing the amount may reduce the likelihood of saturation during generation of the high-band target signal 126. For example, during decimation the high-band target signal generation module 113 may perform additional operations that may cause saturation if there is not enough headroom. Increasing the amount of headroom (or maintaining a pre-defined amount of headroom) may substantially reduce saturation of the high-band target signal 126. For example, referring to FIG. 3B, a time-domain plot of the high-band target signal 126 compared to a reference wideband target signal is shown. The energy level of the high-band target signal 126 closely mimics the energy level of the reference wideband target signal as compared to FIG. 3A where the energy level deviates significantly from the energy level of the reference wideband target signal. Thus, reduced saturation may be achieved.

Although the analysis filter bank 110 includes multiple modules 105, 107, 109, 113, in other implementations, functions of one or more of the modules 105, 107, 109, 113 may be combined. According to one implementation, one or more of the modules 105, 107, 109, 113 may operate to generate and control the precision of the high-band target signal 126 based on the following pseudocode:

```
max_wb = 1;
/* calculate the max value in the input signal buffer of length 320 */
FOR (i = 0; i < 320; i++ ) {
   max_wb = s_max(max_wb, abs_s(new_inp_resamp16k[i]));
}
Q_wb_sp = norm_s(max_wb);
/* shift the signal right by 3 bits, before estimating rxx(0) and rxx(1) */
scale_sig(new_inp_resamp16k, temp_buf, 320, -3);
temp1 = L_mac0(temp1, temp_buf[0], temp_buf[0]);
FOR (i = 1; i < 320; i++) {
   temp1 = L_mac0(temp1, temp_buf[i], temp_buf[i]);
   temp2 = L_mac0(temp2, temp_buf[i-1], temp_buf[i]);
}
if( temp2 < temp1* 0.95) {
   /* if the spectral tilt is not strong, leave 3 more bits of headroom */
   Q_wb_sp = sub(Q_wb_sp, 3);
}
/* scale the signal new_inp_resamp16k as per Q_wb_sp and write to
temp_buf */
scale_sig(new_inp_resamp16k, temp_buf, 320, Q_wb_sp);
/* Flip the spectrum and decimate-by-4 */
flip_spectrum_and_decimby4( );
/* rescale the HB target signal and memories back to Q-1 */
scale_sig(hb_speech, 80, -Q_wb_sp);
```

According to the pseudocode, "max_wb" corresponds to the maximum sample value of the input audio signal 102 and "new_inp_resamp16k[i]" corresponds to the input audio signal 102. For example, new_inp_resamp16k[i] may have a frequency spanning from 0 Hz to 8 kHz and may be sampled at the Nyquist sampling rate of 16 kHz. For each sample, the input audio signal 102 (max_wb) may be set to the maximum absolute value of the input audio signal 102 (new_inp_resamp16k[i]). A parameter ("Q_wb_sp") may indicate a number of bits that the input audio signal 102 (new_inp_resamp16k[i]) may be shifted to left while covering the full range of the signal (new_inp_resamp16k[i]). According to the pseudocode, the parameter (Q_wb_sp) may be equal to a norm of max_wb.

According to pseudocode, the spectral tilt may be based on a ratio between the autocorrelation ($R_1$) at lag index one ("temp2") of the input audio signal 102 and the autocorrelation ($R_0$) at lag index zero ("temp1"). The autocorrelation ($R_1$) at lag index one may be calculated based on a sum of product of adjacent samples.

If the autocorrelation ($R_1$) is less than the threshold (0.95) multiplied by the autocorrelation ($R_0$), the parameter (Q_wb_sp) may maintain additional headroom of three more bits during scaling to reduce the likelihood of saturation during generation of the high-band target signal 126. If the autocorrelation ($R_1$) is not less than the threshold (0.95) multiplied by the autocorrelation ($R_0$), the (Q_wb_sp) may decrease the additional headroom to zero bits during scaling to provide a greater range to generate the high-band target signal 126 such that the energy of the high-band may be more precisely captured. According to the pseudocode, the input signal is shifted left by Q_wb_sp number of bits, meaning the final scale factor selected by the scaling factor selection module 107 would correspond to $2^{Q_wb_sp}$. Precisely capturing the energy of the high-band by the high-band target signal may improve estimation of high-band gain parameters (e.g., high-band side information 172) and reduce artifacts. In some example embodiments, the high band target signal 126 may be rescaled back to the original input level (e.g., in Q-factors: $Q_0$ or $Q_{-1}$), such that the memory updates, high band parameter estimation, and high band synthesis across frames maintain a fixed temporal scale factor adjustment.

The above example illustrates filtering for WB coding (e.g., coding from approximately 0 Hz to 8 kHz). In other examples, the analysis filter bank 110 may filter an input audio signal for SWB coding (e.g., coding from approximately 0 Hz to 16 kHz) and full band (FB) coding (e.g., coding from approximately 0 Hz to 20 kHz). To illustrate. For ease of illustration, unless other noted, the following description is generally described with respect to WB coding. However, similar techniques may be applied to perform SWB coding and FB coding.

The system 100 may include a low-band analysis module 130 configured to receive the low-band signal 122. In a particular implementation, the low-band analysis module 130 may represent a CELP encoder. The low-band analysis module 130 may include an LP analysis and coding module 132, a linear prediction coefficient (LPC) to LSP transform module 134, and a quantizer 136. LSPs may also be referred to as LSFs, and the two terms (LSP and LSF) may be used interchangeably herein. The LP analysis and coding module 132 may encode a spectral envelope of the low-band signal 122 as a set of LPCs. LPCs may be generated for each frame of audio (e.g., 20 ms of audio, corresponding to 320 samples at a sampling rate of 16 kHz), for each sub-frame of audio (e.g., 5 ms of audio), or any combination thereof. The number of LPCs generated for each frame or sub-frame may be determined by the "order" of the LP analysis performed. In a particular implementation, the LP analysis and coding module 132 may generate a set of eleven LPCs corresponding to a tenth-order LP analysis.

The LPC to LSP transform module 134 may transform the set of LPCs generated by the LP analysis and coding module 132 into a corresponding set of LSPs (e.g., using a one-to-one transform). Alternately, the set of LPCs may be one-to-one transformed into a corresponding set of parcor coefficients, log-area-ratio values, immittance spectral pairs (ISPs), or immittance spectral frequencies (ISFs). The transform between the set of LPCs and the set of LSPs may be reversible without error.

The quantizer 136 may quantize the set of LSPs generated by the transform module 134. For example, the quantizer 136 may include or be coupled to multiple codebooks that include multiple entries (e.g., vectors). To quantize the set of LSPs, the quantizer 136 may identify entries of codebooks that are "closest to" (e.g., based on a distortion measure such as least squares or mean square error) the set of LSPs. The quantizer 136 may output an index value or series of index values corresponding to the location of the identified entries in the codebook. The output of the quantizer 136 may thus represent low-band filter parameters that are included in a low-band bit stream 142.

The low-band analysis module 130 may also generate a low-band excitation signal 144. For example, the low-band excitation signal 144 may be an encoded signal that is generated by quantizing a LP residual signal that is generated during the LP process performed by the low-band analysis module 130. The LP residual signal may represent prediction error of the low-band excitation signal 144.

The system 100 may further include a high-band analysis module 150 configured to receive the high-band target signal 126 from the analysis filter bank 110 and to receive the low-band excitation signal 144 from the low-band analysis module 130. The high-band analysis module 150 may generate the high-band side information 172 based on the high-band target signal 126 and based on the low-band excitation signal 144. For example, the high-band side information 172 may include high-band LSPs, gain information, and/or phase information.

As illustrated, the high-band analysis module 150 may include an LP analysis and coding module 152, a LPC to LSP transform module 154, and a quantizer 156. Each of the LP analysis and coding module 152, the transform module 154, and the quantizer 156 may function as described above with reference to corresponding components of the low-band analysis module 130, but at a comparatively reduced resolution (e.g., using fewer bits for each coefficient, LSP, etc.). The LP analysis and coding module 152 may generate a set of LPCs for the high-band target signal 126 that are transformed to a set of LSPs by the transform module 154 and quantized by the quantizer 156 based on a codebook 163.

The LP analysis and coding module 152, the transform module 154, and the quantizer 156 may use the high-band target signal 126 to determine high-band filter information (e.g., high-band LSPs) that is included in the high-band side information 172. For example, the LP analysis and coding module 152, the transform module 154, and the quantizer 156 may use the high-band target signal 126 and a high-band excitation signal 162 to determine the high-band side information 172.

The quantizer 156 may be configured to quantize a set of spectral frequency values, such as LSPs provided by the transform module 154. In other implementations, the quantizer 156 may receive and quantize sets of one or more other types of spectral frequency values in addition to, or instead of, LSFs or LSPs. For example, the quantizer 156 may receive and quantize a set of LPCs generated by the LP analysis and coding module 152. Other examples include sets of parcor coefficients, log-area-ratio values, and ISFs that may be received and quantized at the quantizer 156. The quantizer 156 may include a vector quantizer that encodes an input vector (e.g., a set of spectral frequency values in a vector format) as an index to a corresponding entry in a table or codebook, such as the codebook 163. As another example, the quantizer 156 may be configured to determine one or more parameters from which the input vector may be generated dynamically at a decoder, such as in a sparse codebook implementation, rather than retrieved from storage. To illustrate, sparse codebook examples may be applied in coding schemes such as CELP and codecs according to industry standards such as 3GPP2 (Third Generation Partnership 2) EVRC (Enhanced Variable Rate Codec). In another implementation, the high-band analysis module 150 may include the quantizer 156 and may be configured to use a number of codebook vectors to generate synthesized signals (e.g., according to a set of filter parameters) and to select one of the codebook vectors associated with the synthesized signal that best matches the high-band target signal 126, such as in a perceptually weighted domain.

The high-band analysis module 150 may also include a high-band excitation generator 160. The high-band excitation generator 160 may generate the high-band excitation signal 162 (e.g., a harmonically extended signal) based on the low-band excitation signal 144 from the low-band analysis module 130. The high-band analysis module 150 may also include an LP synthesis module 166. The LP synthesis module 166 uses the LPC information generated by the quantizer 156 to generate a synthesized version of the high-band target signal 126. The high-band excitation generator 160 and the LP synthesis module 166 may be included in a local decoder that emulates performance at a decoder device at a receiver. An output of the LP synthesis module 166 may be used for comparison to the high-band target signal 126 and parameters (e.g., gain parameters) may be adjusted based on the comparison.

The low-band bit stream 142 and the high-band side information 172 may be multiplexed by the multiplexer 170 to generate an output bit stream 199. The output bit stream 199 may represent an encoded audio signal corresponding to the input audio signal 102. The output bit stream 199 may be transmitted (e.g., over a wired, wireless, or optical channel) by a transmitter 198 and/or stored. At a receiver, reverse operations may be performed by a demultiplexer (DEMUX), a low-band decoder, a high-band decoder, and a filter bank to generate an audio signal (e.g., a reconstructed version of the input audio signal 102 that is provided to a speaker or other output device). The number of bits used to represent the low-band bit stream 142 may be substantially larger than the number of bits used to represent the high-band side information 172. Thus, most of the bits in the output bit stream 199 may represent low-band data. The high-band side information 172 may be used at a receiver to regenerate the high-band excitation signals 162, 164 from the low-band data in accordance with a signal model. For example, the signal model may represent an expected set of relationships or correlations between low-band data (e.g., the low-band signal 122) and high-band data (e.g., the high-band target signal 126). Thus, different signal models may be used for different kinds of audio data (e.g., speech, music, etc.), and the particular signal model that is in use may be negotiated by a transmitter and a receiver (or defined by an industry standard) prior to communication of encoded audio data. Using the signal model, the high-band analysis module 150 at a transmitter may be able to generate the high-band side information 172 such that a corresponding high-band analysis module at a receiver is able to use the signal model to reconstruct the high-band target signal 126 from the output bit stream 199.

The system 100 of FIG. 1 may control the precision of the high-band target signal 126 based on the dynamic scaling factor selected by the scaling factor selection module 107. For example, in scenarios where the first energy level of the low-band is significantly greater than the second energy level of the high-band, the input audio signal 102 may be scaled to decrease the amount of headroom. Decreasing the amount of headroom may provide a greater range to generate the high-band target signal 126 such that the energy of the high-band may be more precisely captured. Precisely capturing the energy of the high-band by the high-band target signal may result improve estimation of high-band gain parameters (e.g., high-band side information 172) and reduce artifacts. In scenarios where the first energy level of the low-band is not significantly greater than the second energy level of the high-band, the input audio signal 102 may be scaled to increase the amount of headroom. Increasing the amount may reduce the likelihood of saturation during generation of the high-band target signal 126. For example, during decimation the high-band target signal generation module 113 may perform additional operations that may cause saturation if there is not enough headroom.

Increasing the amount of headroom (or maintaining a predefined amount of headroom) may substantially reduce saturation of the high-band target signal 126.

Figure 4A:
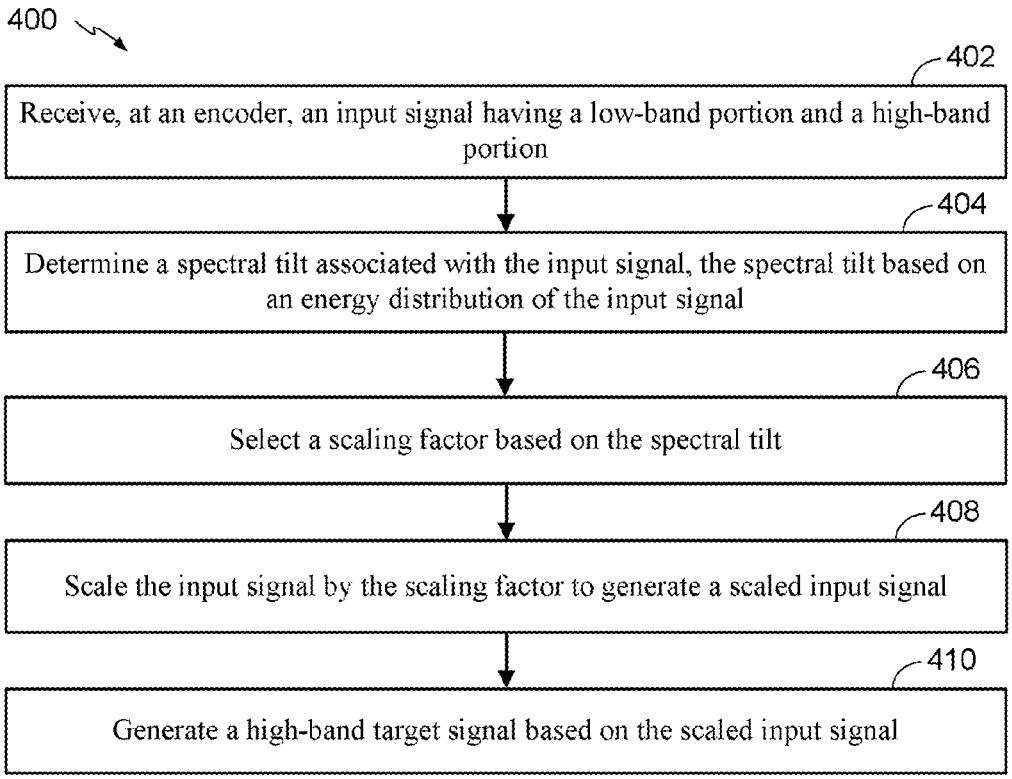
FIG. 4A is a flowchart of a method of generating a high-band target signal.

Referring to FIG. 4A, a flowchart of a method 400 of generating a high-band target signal is shown. The method 400 may be performed by the system 100 of FIG. 1.

The method 400 includes receiving, at an encoder, an input signal having a low-band portion and a high-band portion, at 402. For example, referring to FIG. 1, the analysis filter band 110 may receive the input audio signal 102. In particular, the resampler 103, the spectral tilt analysis module 105, and the scaling module 109 may receive the input audio signal 102. The input audio signal 102 may have a low-band portion that has a frequency range between 0 Hz and 6 kHz. The input audio signal 102 may also have a high-band portion that has a frequency range between 6 kHz and 8 kHz.

A spectral tilt associated with the input signal may be determined, at 404. The spectral tilt may be based on an energy distribution of the input signal. According to one implementation, the energy distribution of the input signal may be based at least in part on a first energy level of the low-band and a second energy level of the high-band. Referring to FIG. 1, the spectral tilt analysis module 105 may determine the spectral tilt associated with the input audio signal 102. The spectral tilt may be based on an energy distribution of the input audio signal 102. For example, the spectral tilt may be based on a ratio between the autocorrelation ($R_0$) at lag index zero representing an energy of the entire frequency band of the input audio signal 102 in the time domain and the autocorrelation ($R_1$) at lag index one representing an energy of the high-band in the time domain. According to one implementation, the autocorrelation ($R_1$) at lag index one may be calculated based on a sum of product of adjacent samples. The spectral tilt may be expressed as the quotient resulting from the autocorrelation ($R_1$) and the autocorrelation ($R_0$) (e.g., $R_1/R_0$). The spectral tilt analysis module 105 may generate the signal 106 indicating the spectral tilt and may provide the signal 106 to the scaling factor selection module 107.

A scaling factor may be selected based on the spectral tilt, at 406. For example, referring to FIG. 1, the scaling factor selection module 107 may select the scaling factor to be used to scale the input audio signal 102. The scaling factor may be based on the spectral tilt indicated by the signal 106. For example, the scaling factor selection module 107 may compare the spectral tilt to a threshold to determine the scaling factor. If the spectral tilt fails to satisfy the threshold (e.g., is not less than the threshold or R1/R0>=0.95), then the scaling factor selection module 107 may select the first scaling factor. Selecting the first scaling factor may indicate a scenario where a first energy level of the low-band is significantly greater than a second energy level of the high-band. For example, the energy distribution of the input audio signal 102 may be relatively steep when the spectral tilt fails to satisfy the threshold. If the spectral tilt satisfies the threshold (e.g., is less than the threshold), then the scaling factor module 107 may select the second scaling factor. Selecting the second scaling factor may indicate a scenario where the first energy level of the low-band is not significantly greater than the second energy level of the high-band. For example, the energy distribution of the input audio signal 102 may be relatively even across the low-band and the high-band when the spectral tile satisfies the threshold criterion (i.e. R1/R0<0.95).

The input signal may be scaled by the scaling factor to generate a scaled input signal, at 408. For example, referring to FIG. 1, the scaling module 109 may scale the input audio signal 102 by the selected scaling factor to generate a scaled input audio signal 112. To illustrate, if the first scaling factor is selected, the scaling module 109 may scale the input audio signal 102 such that the resulting scaled input audio signal 112 has a first amount of headroom. If the second scaling factor is selected, the scaling module 109 may scale the input audio signal 102 such that the resulting scaled input audio signal 112 has a second amount of headroom that is less than the first amount of headroom. According to one implementation, the first amount of headroom may be equal to three bits of headroom, and the second amount of headroom may be equal to zero bits of headroom. Generating a scaled input audio signal 112 having the first amount of headroom may reduce the likelihood of saturation during generation of the high-band target signal 126. Generating a scaled input audio signal 112 having the second amount of headroom may enable more precise energy estimations for a low-energy high-band, which in turn may reduce artifacts.

A high-band target signal may be generated based on the scaled input signal, at 410. For example, referring to FIG. 1, a spectral flip operation may be performed on the scaled input audio signal 112 to generate a spectrally flipped signal. Additionally, a decimation operation may be performed on the spectrally flipped signal to generate the high-band target signal 126. According to one implementation, the decimation operation may decimate the spectrally flipped signal by a factor of four. The method 400 may also include generating a linear prediction spectral envelope, temporal gain parameters, or a combination thereof, based on the high-band target signal.

The method 400 of FIG. 4A may control the precision of the high-band target signal 126 based on the dynamic scaling factor selected by the scaling factor selection module 107. For example, in scenarios where the first energy level of the low-band is significantly greater than the second energy level of the high-band, the input audio signal 102 may be scaled to decrease the amount of headroom. Decreasing the amount of headroom may provide a greater range to generate the high-band target signal 126 such that the energy of the high-band may be more precisely captured. Precisely capturing the energy of the high-band by the high-band target signal may result improve estimation of high-band gain parameters (e.g., high-band side information 172) and reduce artifacts. In scenarios where the first energy level of the low-band is not significantly greater than the second energy level of the high-band, the input audio signal 102 may be scaled to increase the amount of headroom. Increasing the amount may reduce the likelihood of saturation during generation of the high-band target signal 126. For example, during decimation the high-band target signal generation module 113 may perform additional operations that may cause saturation if there is not enough headroom. Increasing the amount of headroom (or maintaining a predefined amount of headroom) may substantially reduce saturation of the high-band target signal 126.

Figure 4B:
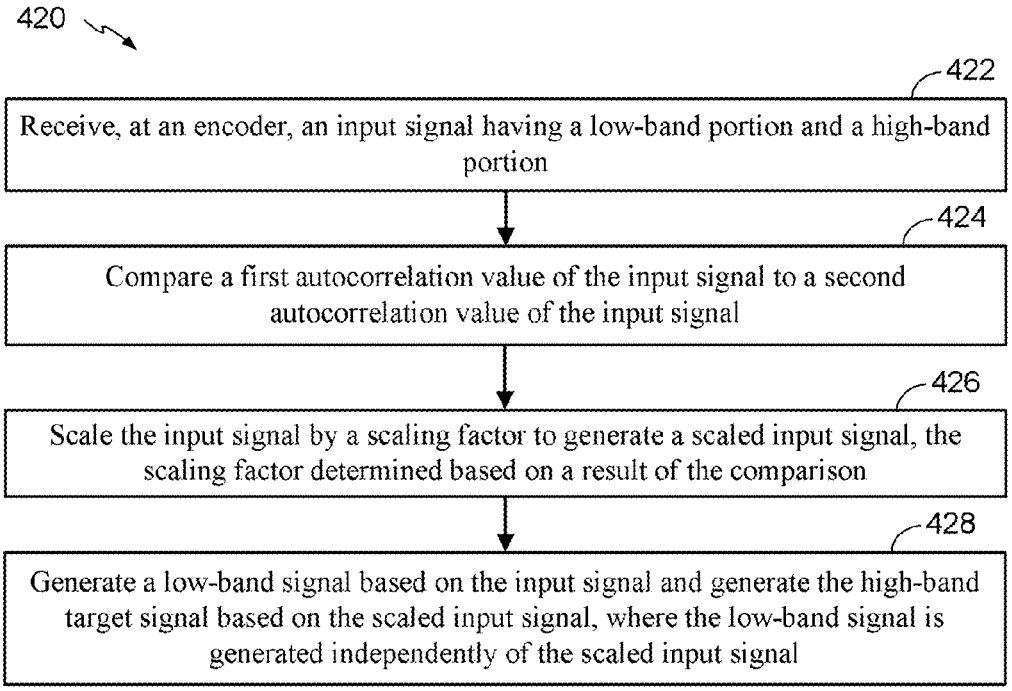
FIG. 4B is another flowchart of a method of generating a high-band target signal.

Referring to FIG. 4B, another flowchart of a method 420 of generating a high-band target signal is shown. The method 420 may be performed by the system 100 of FIG. 1.

The method 420 includes receiving, at an encoder, an input signal having a low-band portion and a high-band portion, at 422. For example, the analysis filter band 110 may receive the input audio signal 102. In particular, the resampler 103, the spectral tilt analysis module 105, and the scaling module 109 may receive the input audio signal 102. The input audio signal 102 may have a low-band portion that has a frequency range between 0 Hz and 6 kHz. The input audio signal 102 may also have a high-band portion that has a frequency range between 6 kHz and 8 kHz.

A first autocorrelation value of the input signal may be compared to a second autocorrelation value of the input signal, at 424. For example, according to pseudocode described above, the analysis filter bank 110 may perform a comparison operation using the autocorrelation ($R_1$) at lag index one ("temp2") of the input audio signal 102 and the autocorrelation ($R_0$) at lag index zero ("temp1"). To illustrate, the analysis filter bank 110 may determine whether the second autocorrelation value (e.g., the autocorrelation ($R_1$) at lag index one) is less than a product of the first autocorrelation value (e.g., the autocorrelation ($R_0$) at lag index zero) and a threshold (e.g., a 95 percent threshold). The autocorrelation ($R_1$) at lag index one may be calculated based on a sum of product of adjacent samples.

The input signal may be scaled by a scaling factor to generate a scaled input signal, at 426. The scaling factor may be determined based on a result of the comparison. For example, referring to FIG. 1, the scaling factor selection module 107 may select a first scaling factor as the scaling factor if the second autocorrelation value ($R_1$) is not less than the product of the first autocorrelation value ($R_0$) and the threshold (e.g., 0.95). The scaling factor selection module 107 may select a second scaling factor as the scaling factor if the second autocorrelation value ($R_1$) is less than the product of the first autocorrelation value ($R_0$) and the threshold (e.g., 0.95). The scaling module 109 may scale the input audio signal 102 by the selected scaling factor to generate a scaled input audio signal 112. To illustrate, if the first scaling factor is selected, the scaling module 109 may scale the input audio signal 102 such that the resulting scaled input audio signal 112 has a first amount of headroom. If the second scaling factor is selected, the scaling module 109 may scale the input audio signal 102 such that the resulting scaled input audio signal 112 has a second amount of headroom that is less than the first amount of headroom. According to one implementation, the first amount of headroom may be equal to three bits of headroom, and the second amount of headroom may be equal to zero bits of headroom. Generating a scaled input audio signal 112 having the first amount of headroom may reduce the likelihood of saturation during generation of the high-band target signal 126. Generating a scaled input audio signal 112 having the second amount of headroom may enable more precise energy estimations for a low-energy high-band, which in turn may reduce artifacts. In other alternative illustrative implementations, the scaling factor selection module 107 may select among multiple scaling factors (e.g., more than 2) based on multiple thresholds of the comparison performed between the first and the second autocorrelation values. Alternatively, the scaling factor selection module 107 may map the first and the second autocorrelation values to an output scaling factor.

In an alternative implementation, the scaling factor selection module 107 may select the first scaling factor as the scaling factor. The scaling factor selection module 107 may modify the value of the scaling factor to the second scaling factor if the second autocorrelation value ($R_1$) is less than the product of the first autocorrelation value ($R_0$) and the threshold (e.g., 0.95). The scaling module 109 may scale the input audio signal 102 by the selected scaling factor to generate a scaled input audio signal 112. To illustrate, if the first scaling factor is selected and the value of the scaling factor is not modified to the second scaling factor, the scaling module 109 may scale the input audio signal 102 such that the resulting scaled input audio signal 112 has a first amount of headroom. If the value of the scaling factor is modified from the first scaling factor to the second scaling factor based on the comparison of the first and the second autocorrelation values, the scaling module 109 may scale the input audio signal 102 such that the resulting scaled input audio signal 112 has a second amount of headroom that is less than the first amount of headroom. According to one implementation, the first amount of headroom may be equal to three bits of headroom, and the second amount of headroom may be equal to zero bits of headroom.

A low-band signal may be generated based on the input signal and a high-band target signal may be generated based on the scaled input signal, at 428. The low-band signal may be generated independently of the scaled input signal. For example, referring to FIG. 1, a spectral flip operation may be performed on the scaled input audio signal 112 to generate a spectrally flipped signal. Additionally, a decimation operation may be performed on the spectrally flipped signal to generate the high-band target signal 126. Additionally, the resampler 103 may filter out high-frequency components of the input audio signal 102 to generate a low-band signal 122.

According to the method 420, if the second autocorrelation value ($R_1$) is less than the threshold (0.95) multiplied by the first autocorrelation value ($R_0$), the parameter (Q_wb_sp) may maintain additional headroom of three more bits during scaling to reduce the likelihood of saturation during generation of the high-band target signal 126. If the second autocorrelation value ($R_1$) is not less than the threshold (0.95) multiplied by the first autocorrelation value ($R_0$), the (Q_wb_sp) may decrease the additional headroom to zero bits during scaling to provide a greater range to generate the high-band target signal 126 such that the energy of the high-band may be more precisely captured. According to the pseudocode, the input signal is shifted left by Q_wb_sp number of bits, meaning the final scale factor selected by 107 would correspond to $2^{Q_wb_sp}$. Precisely capturing the energy of the high-band by the high-band target signal may result improve estimation of high-band gain parameters (e.g., high-band side information 172) and reduce artifacts. In some example embodiments, the high band target signal 126 may be rescaled back to the original input level (e.g., in Q-factors: $Q_0$ or $Q_{-1}$), such that the memory updates, high band parameter estimation, and high band synthesis across frames maintain a fixed temporal scale factor adjustment.

The method 420 of FIG. 4B may control the precision of the high-band target signal 126 based on the dynamic scaling factor selected by the scaling factor selection module 107. For example, in scenarios where the first energy level of the low-band is significantly greater than the second energy level of the high-band, the input audio signal 102 may be scaled to decrease the amount of headroom. Decreasing the amount of headroom may provide a greater range to generate the high-band target signal 126 such that the energy of the high-band may be more precisely captured.

In particular implementations, the methods 400, 420 of FIGS. 4A-4B may be implemented via hardware (e.g., an FPGA device, an ASIC, etc.) of a processing unit, such as a central processing unit (CPU), a DSP, or a controller, via a firmware device, or any combination thereof. As an example, the methods 400, 420 of FIGS. 4A-4B can be performed by a processor that executes instructions, as described with respect to FIG. 5.

Figure 5:
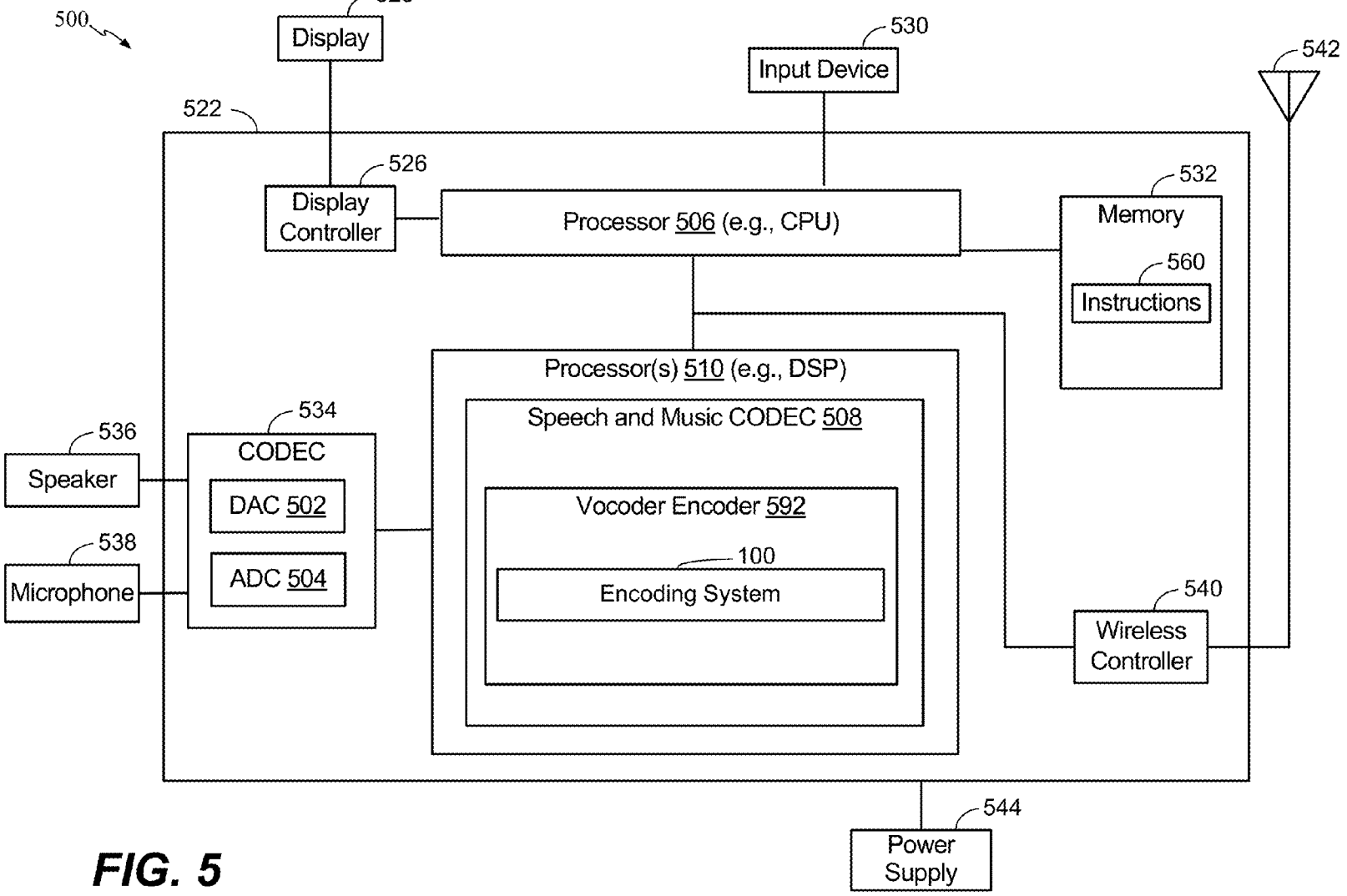
FIG. 5 is a block diagram of a wireless device operable to control precision of a high-band target signal.

Referring to FIG. 5, a block diagram of a device is depicted and generally designated 500. In a particular implementation, the device 500 includes a processor 506 (e.g., a CPU). The device 500 may include one or more additional processors 510 (e.g., one or more DSPs). The processors 510 may include a speech and music CODEC 508. The speech and music CODEC 508 may include a vocoder encoder 592, a vocoder decoder (not shown), or both. In a particular implementation, the vocoder encoder 592 may include an encoding system, such as the system 100 of FIG. 1.

The device 500 may include a memory 532 and a wireless controller 540 coupled to an antenna 542. The device 500 may include a display 528 coupled to a display controller 526. A speaker 536, a microphone 538, or both may be coupled to the CODEC 534. The CODEC 534 may include a digital-to-analog converter (DAC) 502 and an analog-to-digital converter (ADC) 504.

In a particular implementation, the CODEC 534 may receive analog signals from the microphone 538, convert the analog signals to digital signals using the analog-to-digital converter 504, and provide the digital signals to the speech and music CODEC 508, such as in a pulse code modulation (PCM) format. The speech and music CODEC 508 may process the digital signals. In a particular implementation, the speech and music CODEC 508 may provide digital signals to the CODEC 534. The CODEC 534 may convert the digital signals to analog signals using the digital-to-analog converter 502 and may provide the analog signals to the speaker 536.

The memory 532 may include instructions 560 executable by the processor 506, the processors 510, the CODEC 534, another processing unit of the device 500, or a combination thereof, to perform methods and processes disclosed herein, such as the methods 400, 420 of FIGS. 4A-4B. One or more components of the system 100 of FIG. 1 may be implemented via dedicated hardware (e.g., circuitry), by a processor executing instructions (e.g., the instructions 560) to perform one or more tasks, or a combination thereof. As an example, the memory 532 or one or more components of the processor 506, the processors 510, and/or the CODEC 534 may be a memory device, such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include instructions (e.g., the instructions 560) that, when executed by a computer (e.g., a processor in the CODEC 534, the processor 506, and/or the processors 510), may cause the computer to perform the methods 400, 420 of FIGS. 4A-4B. As an example, the memory 532 or the one or more components of the processor 506, the processors 510, and/or the CODEC 534 may be a non-transitory computer-readable medium that includes instructions (e.g., the instructions 560) that, when executed by a computer (e.g., a processor in the CODEC 534, the processor 506, and/or the processors 510), cause the computer perform at least a portion of the methods 400, 420 FIGS. 4A-4B.

In a particular implementation, the device 500 may be included in a system-in-package or system-on-chip device 522, such as a mobile station modem (MSM). In a particular implementation, the processor 506, the processors 510, the display controller 526, the memory 532, the CODEC 534, and the wireless controller 540 are included in a system-in-package or the system-on-chip device 522. In a particular implementation, an input device 530, such as a touchscreen and/or keypad, and a power supply 544 are coupled to the system-on-chip device 522. Moreover, in a particular implementation, as illustrated in FIG. 5, the display 528, the input device 530, the speaker 536, the microphone 538, the antenna 542, and the power supply 544 are external to the system-on-chip device 522. However, each of the display 528, the input device 530, the speaker 548, the microphone 546, the antenna 542, and the power supply 544 can be coupled to a component of the system-on-chip device 522, such as an interface or a controller. In an illustrative example, the device 500 corresponds to a mobile communication device, a smartphone, a cellular phone, a laptop computer, a computer, a tablet computer, a personal digital assistant, a display device, a television, a gaming console, a music player, a radio, a digital video player, an optical disc player, a tuner, a camera, a navigation device, a decoder system, an encoder system, or any combination thereof.

In conjunction with the described implementations, an apparatus includes means for receiving an input signal having a low-band portion and a high-band portion. For example, the means for receiving the input signal may include the analysis filter bank 110 of FIG. 1, the resampler 103 of FIG. 1, the spectral tilt analysis module 105 of FIG. 1, the scaling module 109 of FIG. 1, the speech and music CODEC 508 of FIG. 5, the vocoder encoder 592 of FIG. 5, one or more devices configured to receive the input signal (e.g., a processor executing instructions at a non-transitory computer readable storage medium), or a combination thereof.

The apparatus may also include means for comparing a first autocorrelation value of the input signal to a second autocorrelation value of the input signal. For example, the means for comparing may include the analysis filter bank 110 of FIG. 1, the speech and music CODEC 508 of FIG. 5, the vocoder encoder 592 of FIG. 5, one or more devices configured to compare the first autocorrelation value to the second autocorrelation value (e.g., a processor executing instructions at a non-transitory computer readable storage medium), or a combination thereof.

The apparatus may also include means for scaling the input signal by the scaling factor to generate a scaled input signal. The scaling factor may be determined based on a result of the comparison. For example, the means for scaling the input signal may include the analysis filter bank 110 of FIG. 1, the scaling module 109 of FIG. 1, the speech and music CODEC 508 of FIG. 5, the vocoder encoder 592 of FIG. 5, one or more devices configured to scale the input signal (e.g., a processor executing instructions at a non-transitory computer readable storage medium), or a combination thereof.

The apparatus may also include means for generating a low-band signal based on the input signal. The low-band signal may be generated independently of the scaled input signal. For example, the means for generating the low-band signal may include the analysis filter bank 110 of FIG. 1, the resampler 103 of FIG. 1, the speech and music CODEC 508 of FIG. 5, the vocoder encoder 592 of FIG. 5, one or more devices configured to generate the high-band target signal (e.g., a processor executing instructions at a non-transitory computer readable storage medium), or a combination thereof.

The apparatus may also include means for generating a high-band target signal based on the scaled input signal. For example, the means for generating the high-band target signal may include the analysis filter bank 110 of FIG. 1, the high-band target signal generation module 113 of FIG. 1, the speech and music CODEC 508 of FIG. 5, the vocoder encoder 592 of FIG. 5, one or more devices configured to generate the low-band signal (e.g., a processor executing instructions at a non-transitory computer readable storage medium), or a combination thereof.

Figure 6:
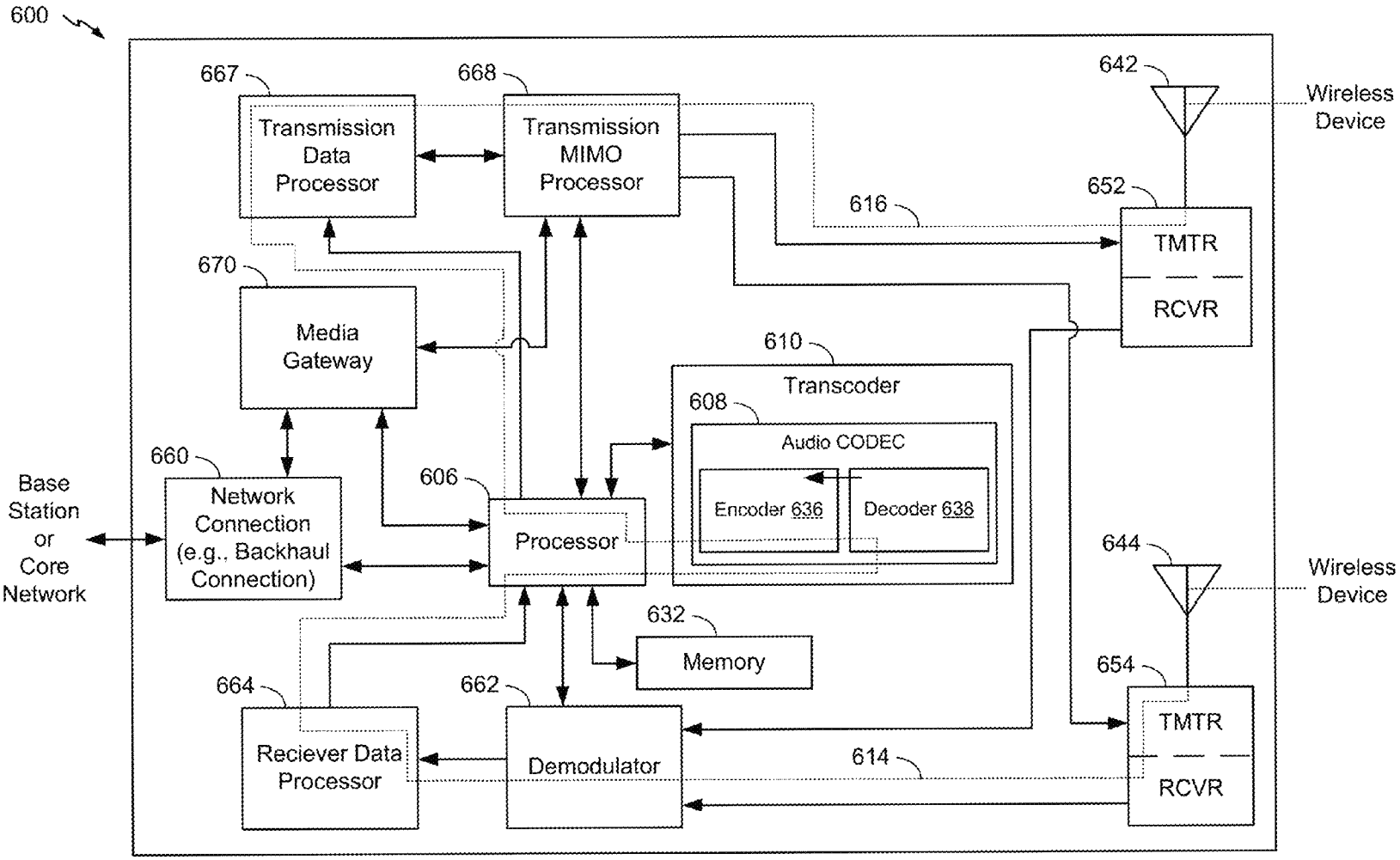
FIG. 6 is a block diagram of a base station that is operable to control precision of a high-band target signal.

Referring to FIG. 6, a block diagram of a particular illustrative example of a base station 600 is depicted. In various implementations, the base station 600 may have more components or fewer components than illustrated in FIG. 6. In an illustrative example, the base station 600 may include the system 100 of FIG. 1. In an illustrative example, the base station 600 may operate according to the method 400 of FIG. 4A, the method 420 of FIG. 4B, or a combination thereof.

The base station 600 may be part of a wireless communication system. The wireless communication system may include multiple base stations and multiple wireless devices. The wireless communication system may be a Long Term Evolution (LTE) system, a Code Division Multiple Access (CDMA) system, a Global System for Mobile Communications (GSM) system, a wireless local area network (WLAN) system, or some other wireless system. A CDMA system may implement Wideband CDMA (WCDMA), CDMA 1X, Evolution-Data Optimized (EVDO), Time Division Synchronous CDMA (TD-SCDMA), or some other version of CDMA.

The wireless devices may also be referred to as user equipment (UE), a mobile station, a terminal, an access terminal, a subscriber unit, a station, etc. The wireless devices may include a cellular phone, a smartphone, a tablet, a wireless modem, a personal digital assistant (PDA), a handheld device, a laptop computer, a smartbook, a netbook, a tablet, a cordless phone, a wireless local loop (WLL) station, a Bluetooth device, etc. The wireless devices may include or correspond to the device 500 of FIG. 5.

Various functions may be performed by one or more components of the base station 600 (and/or in other components not shown), such as sending and receiving messages and data (e.g., audio data). In a particular example, the base station 600 includes a processor 606 (e.g., a CPU). The base station 600 may include a transcoder 610. The transcoder 610 may include an audio 608 CODEC. For example, the transcoder 610 may include one or more components (e.g., circuitry) configured to perform operations of the audio CODEC 608. As another example, the transcoder 610 may be configured to execute one or more computer-readable instructions to perform the operations of the audio CODEC 608. Although the audio CODEC 608 is illustrated as a component of the transcoder 610, in other examples one or more components of the audio CODEC 608 may be included in the processor 606, another processing component, or a combination thereof. For example, a vocoder decoder 638 may be included in a receiver data processor 664. As another example, a vocoder encoder 636 may be included in a transmission data processor 667.

The transcoder 610 may function to transcode messages and data between two or more networks. The transcoder 610 may be configured to convert message and audio data from a first format (e.g., a digital format) to a second format. To illustrate, the vocoder decoder 638 may decode encoded signals having a first format and the vocoder encoder 636 may encode the decoded signals into encoded signals having a second format. Additionally or alternatively, the transcoder 610 may be configured to perform data rate adaptation. For example, the transcoder 610 may downconvert a data rate or upconvert the data rate without changing a format the audio data. To illustrate, the transcoder 610 may downconvert 64 kbit/s signals into 16 kbit/s signals.

The audio CODEC 608 may include the vocoder encoder 636 and the vocoder decoder 638. The vocoder encoder 636 may include an encode selector, a speech encoder, and a music encoder, as described with reference to FIG. 5. The vocoder decoder 638 may include a decoder selector, a speech decoder, and a music decoder.

The base station 600 may include a memory 632. The memory 632, such as a computer-readable storage device, may include instructions. The instructions may include one or more instructions that are executable by the processor 606, the transcoder 610, or a combination thereof, to perform the method 400 of FIG. 4A, the method 420 of FIG. 4B, or a combination thereof. The base station 600 may include multiple transmitters and receivers (e.g., transceivers), such as a first transceiver 652 and a second transceiver 654, coupled to an array of antennas. The array of antennas may include a first antenna 642 and a second antenna 644. The array of antennas may be configured to wirelessly communicate with one or more wireless devices, such as the device 500 of FIG. 5. For example, the second antenna 644 may receive a data stream 614 (e.g., a bit stream) from a wireless device. The data stream 614 may include messages, data (e.g., encoded speech data), or a combination thereof.

The base station 600 may include a network connection 660, such as backhaul connection. The network connection 660 may be configured to communicate with a core network or one or more base stations of the wireless communication network. For example, the base station 600 may receive a second data stream (e.g., messages or audio data) from a core network via the network connection 660. The base station 600 may process the second data stream to generate messages or audio data and provide the messages or the audio data to one or more wireless device via one or more antennas of the array of antennas or to another base station via the network connection 660. In a particular implementation, the network connection 660 may be a wide area network (WAN) connection, as an illustrative, non-limiting example. In some implementations, the core network may include or correspond to a Public Switched Telephone Network (PSTN), a packet backbone network, or both.

The base station 600 may include a media gateway 670 that is coupled to the network connection 660 and the processor 606. The media gateway 670 may be configured to convert between media streams of different telecommunications technologies. For example, the media gateway 670 may convert between different transmission protocols, different coding schemes, or both. To illustrate, the media gateway 670 may convert from PCM signals to Real-Time Transport Protocol (RTP) signals, as an illustrative, non-limiting example. The media gateway 670 may convert data between packet switched networks (e.g., a Voice Over Internet Protocol (VoIP) network, an IP Multimedia Subsystem (IMS), a fourth generation (4G) wireless network, such as LTE, WiMax, and UMB, etc.), circuit switched networks (e.g., a PSTN), and hybrid networks (e.g., a second generation (2G) wireless network, such as GSM, GPRS, and EDGE, a third generation (3G) wireless network, such as WCDMA, EV-DO, and HSPA, etc.).

Additionally, the media gateway 670 may include a transcoder, such as the transcoder 610, and may be configured to transcode data when codecs are incompatible. For example, the media gateway 670 may transcode between an Adaptive Multi-Rate (AMR) codec and a G.711 codec, as an illustrative, non-limiting example. The media gateway 670 may include a router and a plurality of physical interfaces. In some implementations, the media gateway 670 may also include a controller (not shown). In a particular implementation, the media gateway controller may be external to the media gateway 670, external to the base station 600, or both.

The media gateway controller may control and coordinate operations of multiple media gateways. The media gateway 670 may receive control signals from the media gateway controller and may function to bridge between different transmission technologies and may add service to end-user capabilities and connections.

The base station 600 may include a demodulator 662 that is coupled to the transceivers 652, 654, the receiver data processor 664, and the processor 606, and the receiver data processor 664 may be coupled to the processor 606. The demodulator 662 may be configured to demodulate modulated signals received from the transceivers 652, 654 and to provide demodulated data to the receiver data processor 664. The receiver data processor 664 may be configured to extract a message or audio data from the demodulated data and send the message or the audio data to the processor 606.

The base station 600 may include a transmission data processor 667 and a transmission multiple input-multiple output (MIMO) processor 668. The transmission data processor 667 may be coupled to the processor 606 and the transmission MIMO processor 668. The transmission MIMO processor 668 may be coupled to the transceivers 652, 654 and the processor 606. In some implementations, the transmission MIMO processor 668 may be coupled to the media gateway 670. The transmission data processor 667 may be configured to receive the messages or the audio data from the processor 606 and to code the messages or the audio data based on a coding scheme, such as CDMA or orthogonal frequency-division multiplexing (OFDM), as an illustrative, non-limiting examples. The transmission data processor 667 may provide the coded data to the transmission MIMO processor 668.

The coded data may be multiplexed with other data, such as pilot data, using CDMA or OFDM techniques to generate multiplexed data. The multiplexed data may then be modulated (i.e., symbol mapped) by the transmission data processor 667 based on a particular modulation scheme (e.g., Binary phase-shift keying ("BPSK"), Quadrature phase-shift keying ("QSPK"), M-ary phase-shift keying ("M-PSK"), M-ary Quadrature amplitude modulation ("M-QAM"), etc.) to generate modulation symbols. In a particular implementation, the coded data and other data may be modulated using different modulation schemes. The data rate, coding, and modulation for each data stream may be determined by instructions executed by processor 606.

The transmission MIMO processor 668 may be configured to receive the modulation symbols from the transmission data processor 667 and may further process the modulation symbols and may perform beamforming on the data. For example, the transmission MIMO processor 668 may apply beamforming weights to the modulation symbols. The beamforming weights may correspond to one or more antennas of the array of antennas from which the modulation symbols are transmitted.

During operation, the second antenna 644 of the base station 600 may receive a data stream 614. The second transceiver 654 may receive the data stream 614 from the second antenna 644 and may provide the data stream 614 to the demodulator 662. The demodulator 662 may demodulate modulated signals of the data stream 614 and provide demodulated data to the receiver data processor 664. The receiver data processor 664 may extract audio data from the demodulated data and provide the extracted audio data to the processor 606.

The processor 606 may provide the audio data to the transcoder 610 for transcoding. The vocoder decoder 638 of the transcoder 610 may decode the audio data from a first format into decoded audio data and the vocoder encoder 636 may encode the decoded audio data into a second format. In some implementations, the vocoder encoder 636 may encode the audio data using a higher data rate (e.g., upconvert) or a lower data rate (e.g., downconvert) than received from the wireless device. In other implementations the audio data may not be transcoded. Although transcoding (e.g., decoding and encoding) is illustrated as being performed by a transcoder 610, the transcoding operations (e.g., decoding and encoding) may be performed by multiple components of the base station 600. For example, decoding may be performed by the receiver data processor 664 and encoding may be performed by the transmission data processor 667. In other implementations, the processor 606 may provide the audio data to the media gateway 670 for conversion to another transmission protocol, coding scheme, or both. The media gateway 670 may provide the converted data to another base station or core network via the network connection 660.

The vocoder decoder 638, the vocoder encoder 636, or both may receive the parameter data and may identify the parameter data on a frame-by-frame basis. The vocoder decoder 638, the vocoder encoder 636, or both may classify, on a frame-by-frame basis, the synthesized signal based on the parameter data. The synthesized signal may be classified as a speech signal, a non-speech signal, a music signal, a noisy speech signal, a background noise signal, or a combination thereof. The vocoder decoder 638, the vocoder encoder 636, or both may select a particular decoder, encoder, or both based on the classification. Encoded audio data generated at the vocoder encoder 636, such as transcoded data, may be provided to the transmission data processor 667 or the network connection 660 via the processor 606.

The transcoded audio data from the transcoder 610 may be provided to the transmission data processor 667 for coding according to a modulation scheme, such as OFDM, to generate the modulation symbols. The transmission data processor 667 may provide the modulation symbols to the transmission MIMO processor 668 for further processing and beamforming. The transmission MIMO processor 668 may apply beamforming weights and may provide the modulation symbols to one or more antennas of the array of antennas, such as the first antenna 642 via the first transceiver 652. Thus, the base station 600 may provide a transcoded data stream 616, that corresponds to the data stream 614 received from the wireless device, to another wireless device. The transcoded data stream 616 may have a different encoding format, data rate, or both, than the data stream 614. In other implementations, the transcoded data stream 616 may be provided to the network connection 660 for transmission to another base station or a core network.

The base station 600 may therefore include a computer-readable storage device (e.g., the memory 632) storing instructions that, when executed by a processor (e.g., the processor 606 or the transcoder 610), cause the processor to perform operations including decoding an encoded audio signal to generate a synthesized signal. The operations may also include classifying the synthesized signal based on at least one parameter determined from the encoded audio signal.

Those of skill would further appreciate that the various illustrative logical blocks, configurations, modules, circuits, and algorithm steps described in connection with the implementations disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the implementations disclosed herein may be embodied directly in hardware, in a software module executed by a processor, or in a combination of the two. A software module may reside in a memory device, such as random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). An exemplary memory device is coupled to the processor such that the processor can read information from, and write information to, the memory device. In the alternative, the memory device may be integral to the processor. The processor and the storage medium may reside in an ASIC. The ASIC may reside in a computing device or a user terminal. In the alternative, the processor and the storage medium may reside as discrete components in a computing device or a user terminal.

The previous description of the disclosed implementations is provided to enable a person skilled in the art to make or use the disclosed implementations. Various modifications to these implementations will be readily apparent to those skilled in the art, and the principles defined herein may be applied to other implementations without departing from the scope of the disclosure. Thus, the present disclosure is not intended to be limited to the implementations shown herein but is to be accorded the widest scope possible consistent with the principles and novel features as defined by the following claims.

What is claimed is:

1. A method for generating a high-band target signal, the method comprising:

receiving, at an encoder, an input signal having a low-band portion and a high-band portion;

comparing a first autocorrelation value of the input signal to a second autocorrelation value of the input signal;

scaling the input signal by a scaling factor to generate a scaled input signal, the scaling factor determined based on a result of the comparison;

generating a low-band signal based on the input signal, wherein the low-band signal is generated independently of the scaled input signal;

generating the high-band target signal based on the scaled input signal;

generating high-band side information based on the high-band target signal; and transmitting the high-band side information as part of a bit-stream to a receiver, the high-band side information usable by the receiver to reconstruct the input signal.

2. The method of claim 1, wherein comparing the first autocorrelation value to the second autocorrelation value comprises comparing the second autocorrelation value to a product of the first autocorrelation value and a threshold, and wherein scaling the input signal by the scaling factor comprises:

scaling the input signal by a first scaling factor if the comparison generates a first result; or scaling the input signal by a second scaling factor if the comparison generates a second result.

3. The method of claim 2, wherein the scaled input signal has a first amount of headroom in response to scaling the input signal by the first scaling factor, wherein the scaled input signal has a second amount of headroom in response to scaling the input signal by the second scaling factor, and wherein the second amount of headroom is greater than the first amount of headroom.

4. The method of claim 3, wherein the first amount of headroom is equal to zero bits of headroom, and wherein the second amount of headroom is equal to three bits of headroom.

5. The method of claim 1, further comprising:

performing a spectral flip operation on the scaled input signal to generate a spectrally flipped signal; and performing a decimation operation on the spectrally flipped signal to generate the high-band target signal.

6. The method of claim 5, wherein the decimation operation decimates the spectrally flipped signal by a factor of four.

7. The method of claim 1, wherein the low-band portion has a frequency range between 0 Hertz (Hz) and 6 Kilohertz (kHz).

8. The method of claim 1, wherein the high-band portion has a frequency range between 6 Kilohertz (kHz) and 8 kHz.

9. The method of claim 1, further comprising generating a linear prediction spectral envelope, temporal gain parameters, or a combination thereof, based on the high-band target signal.

10. The method of claim 1, wherein energy distribution of the input signal is based at least in part on a first energy level of the low-band and a second energy level of the high-band.

11. The method of claim 1, wherein comparing the first autocorrelation value to the second autocorrelation value and scaling the input signal are performed at a device that comprises a mobile communication device.

12. The method of claim 1, wherein comparing the first autocorrelation value to the second autocorrelation value and scaling the input signal are performed at a device that comprises a base station.

13. An apparatus comprising:

an encoder; and a memory storing instructions executable by a processor within the encoder to perform operations comprising:

comparing a first autocorrelation value of an input signal to a second autocorrelation value of the input signal, the input signal having a low-band portion and a high-band portion;

scaling the input signal by a scaling factor to generate a scaled input signal, the scaling factor determined based on a result of the comparison;

generating a low-band signal based on the input signal, wherein the low-band signal is generated independently of the scaled input signal;

generating a high-band target signal based on the scaled input signal;

generating high-band side information based on the high-band target signal; and initiating transmission of the high-band side information as part of a bit-stream to be sent to a receiver, the high-band side information usable by the receiver to reconstruct the input signal.

14. The apparatus of claim 13, wherein comparing the first autocorrelation value to the second autocorrelation value comprises comparing the second autocorrelation value to a product of the first autocorrelation value and a threshold, and wherein scaling the input signal by the scaling factor comprises:

scaling the input signal by a first scaling factor if the comparison generates a first result; or scaling the input signal by a second scaling factor if the comparison generates a second result.

15. The apparatus of claim 14, wherein the scaled input signal has a first amount of headroom in response to scaling the input signal by the first scaling factor, wherein the scaled input signal has a second amount of headroom in response to scaling the input signal by the second scaling factor, and wherein the second amount of headroom is greater than the first amount of headroom.

16. The apparatus of claim 15, wherein the first amount of headroom is equal to zero bits of headroom, and wherein the second amount of headroom is equal to three bits of headroom.

17. The apparatus of claim 13, wherein the operations further comprise:

performing a spectral flip operation on the scaled input signal to generate a spectrally flipped signal; and performing a decimation operation on the spectrally flipped signal to generate the high-band target signal.

18. The apparatus of claim 17, wherein the decimation operation decimates the spectrally flipped signal by a factor of four.

19. The apparatus of claim 13, wherein the low-band portion has a frequency range between 0 Hertz (Hz) and 6 Kilohertz (kHz).

20. The apparatus of claim 13, wherein the high-band portion has a frequency range between 6 Kilohertz (kHz) and 8 kHz.

21. The apparatus of claim 13, wherein the operations further comprise generating a linear prediction spectral envelope, temporal gain parameters, or a combination thereof, based on the high-band target signal.

22. The apparatus of claim 13, wherein energy distribution of the input signal is based at least in part on a first energy level of the low-band and a second energy level of the high-band.

23. The apparatus of claim 13, further comprising:

an antenna; and a transmitter coupled to the antenna and configured to transmit an encoded audio signal.

24. The apparatus of claim 23, wherein the encoder, the memory, and the transmitter are integrated into a mobile communication device.

25. The apparatus of claim 23, wherein the encoder, the memory, and the transmitter are integrated into a base station.

26. A non-transitory computer-readable medium comprising instructions for generating a high-band target signal, the instructions, when executed by a processor within an encoder, cause the processor to perform operations comprising:

comparing a first autocorrelation value of an input signal to a second autocorrelation value of the input signal, the input signal having a low-band portion and a high-band portion;

scaling the input signal by a scaling factor to generate a scaled input signal, the scaling factor determined based on a result of the comparison;

generating a low-band signal based on the input signal, wherein the low-band signal is generated independently of the scaled input signal;

generating the high-band target signal based on the scaled input signal;

generating high-band side information based on the high-band target signal; and initiating transmission of the high-band side information as part of a bit-stream to be sent to a receiver, the high-band side information usable by the receiver to reconstruct the input signal.

27. The non-transitory computer-readable medium of claim 26, wherein comparing the first autocorrelation value to the second autocorrelation value comprises comparing the second autocorrelation value to a product of the first autocorrelation value and a threshold, and wherein scaling the input signal by the scaling factor comprises:

scaling the input signal by a first scaling factor if the comparison generates a first result; or scaling the input signal by a second scaling factor if the comparison generates a second result.

28. The non-transitory computer-readable medium of claim 27, wherein the scaled input signal has a first amount of headroom in response to scaling the input signal by the first scaling factor, wherein the scaled input signal has a second amount of headroom in response to scaling the input signal by the second scaling factor, and wherein the second amount of headroom is greater than the first amount of headroom.

29. The non-transitory computer-readable medium of claim 28, wherein the first amount of headroom is equal to zero bits of headroom, and wherein the second amount of headroom is equal to three bits of headroom.

30. The non-transitory computer-readable medium of claim 26, wherein the operations further comprise:

performing a spectral flip operation on the scaled input signal to generate a spectrally flipped signal; and performing a decimation operation on the spectrally flipped signal to generate the high-band target signal.

31. The non-transitory computer-readable medium of claim 30, wherein the decimation operation decimates the spectrally flipped signal by a factor of four.

32. The non-transitory computer-readable medium of claim 26, wherein the low-band portion has a frequency range between 0 Hertz (Hz) and 6 Kilohertz (kHz).

33. An apparatus comprises:

means for receiving an input signal having a low-band portion and a high-band portion;

means for comparing a first autocorrelation value of the input signal to a second autocorrelation value of the input signal;

means for scaling the input signal by a scaling factor to generate a scaled input signal, the scaling factor determined based on a result of the comparison;

means for generating a low-band signal based on the input signal, wherein the low-band signal is generated independently of the scaled input signal;

means for generating the high-band target signal based on the scaled input signal;

means for generating high-band side information based on the high-band target signal; and means for transmitting the high-band side information as part of a bit-stream to a receiver, the high-band side information usable by the receiver to reconstruct the input signal.

34. The apparatus of claim 33, further comprising:

means for performing a spectral flip operation on the scaled input signal to generate a spectrally flipped signal; and means for performing a decimation operation on the spectrally flipped signal to generate the high-band target signal.

35. The apparatus of claim 33, further comprising means for generating a linear prediction spectral envelope, temporal gain parameters, or a combination thereof, based on the high-band target signal.

36. The apparatus of claim 33, wherein the means for receiving the input signal and the means for generating the high-band target signal are integrated into a mobile communication device.

37. The apparatus of claim 33, wherein the means for receiving the input signal and the means for generating the high-band target signal are integrated into a base station.

* * * * *